US007926201B2

(12) United States Patent
Kim et al.

(10) Patent No.: US 7,926,201 B2
(45) **Date of Patent: *Apr. 19, 2011**

(54) DRYER WITH CLOGGING DETECTING FUNCTION

(75) Inventors: Ju-hyun Kim, Jinhae-shi (KR); Kyung-hun Kim, Changwon-shi (KR); Sun-cheol Bae, Masan-shi (KR); Jin-seok Hu, Masan-shi (KR); Yang-hwan Kim, Busan (KR); Ju-young Min, Changwon-shi (KR); Ja-in Koo, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 748 days.

This patent is subject to a terminal disclaimer.

(21) Appl. No.: 11/850,080

(22) Filed: Sep. 5, 2007

(65) Prior Publication Data

US 2008/0078100 A1 Apr. 3, 2008

(30) Foreign Application Priority Data

Sep. 6, 2006 (KR) ..... 10-2006-0085857
Sep. 6, 2006 (KR) ..... 10-2006-0085858
Sep. 6, 2006 (KR) ..... 10-2006-0085860
Dec. 26, 2006 (KR) ..... 10-2006-0133892
Dec. 26, 2006 (KR) ..... 10-2006-0133894

(51) Int. Cl.
*F26B 11/02* (2006.01)

(52) U.S. Cl. ..... 34/524; 34/562; 34/606; 68/5 C; 68/17 R; 700/208; 62/352; 62/138; 119/245; 15/353; 15/300.1

(58) Field of Classification Search ..... 34/474, 34/524, 549, 562, 606, 210, 90, 381; 68/5 C, 68/17 R; 700/208; 62/352, 138; 119/245; 15/353, 300.1

See application file for complete search history.

(56) References Cited

U.S. PATENT DOCUMENTS 3,363,326 A * 1/1968 Weeks ..... 34/528
3,583,688 A * 6/1971 Fuqua et al. ..... 432/44
4,206,552 A * 6/1980 Pomerantz et al. ..... 34/445
4,231,166 A * 11/1980 McMillan ..... 34/553
4,243,373 A * 1/1981 Fernstrom et al. ..... 431/66
4,286,391 A * 9/1981 Gerry ..... 34/543
4,372,054 A * 2/1983 Pomerantz et al. ..... 34/526
4,385,452 A 5/1983 Deschaaf et al.

(Continued)

FOREIGN PATENT DOCUMENTS

CN 1349013 5/2002

(Continued)

OTHER PUBLICATIONS

Chinese Office Action dated Apr. 24, 2009.

(Continued)

*Primary Examiner* — Stephen M. Gravini
(74) *Attorney, Agent, or Firm* — KED & Associates LLP

(57) ABSTRACT

A clogging detecting apparatus for a dryer is provided that checks and displays a clogging degree of an air passage. The clogging detecting apparatus includes a judgment device for judging the clogging degree of the air passage, a storing device for storing the clogging degree of the air passage, and a display for displaying the clogging degree to the user. The clogging detecting apparatus provides information on the clogging degree, so that the user precisely checks the state of the air passage.

19 Claims, 18 Drawing Sheets

U.S. PATENT DOCUMENTS 4,397,101 A * 8/1983 Rickard ..... 34/486
4,422,247 A 12/1983 Deschaaf
4,485,566 A * 12/1984 Vivares ..... 34/547
4,514,914 A * 5/1985 Kitzmiller ..... 34/93
4,520,576 A 6/1985 Vander Molen
4,531,305 A * 7/1985 Nagayasu et al. ..... 34/445
4,549,362 A 10/1985 Haried
4,622,759 A * 11/1986 Abe et al. ..... 34/546
4,638,374 A * 1/1987 Yoshitake et al. ..... 386/47
4,651,748 A * 3/1987 Vinogradov et al. ..... 600/493
4,713,894 A * 12/1987 Roth et al. ..... 34/486
4,738,034 A 4/1988 Muramatsu et al.
4,763,425 A 8/1988 Grennan
4,788,775 A * 12/1988 Ahmed ..... 34/552
4,827,627 A * 5/1989 Cardoso ..... 34/526
5,050,313 A * 9/1991 Wakaeya et al. ..... 34/454
5,090,221 A * 2/1992 Sewter et al. ..... 68/18 R
5,097,606 A 3/1992 Harmelink et al.
5,187,879 A * 2/1993 Holst ..... 34/261
5,207,764 A 5/1993 Akabane et al.
5,291,667 A 3/1994 Joslin et al.
5,321,897 A * 6/1994 Holst et al. ..... 34/260
5,367,787 A 11/1994 Ikeda et al.
5,444,924 A 8/1995 Joslin et al.
5,497,563 A * 3/1996 Mayfield ..... 34/572
5,544,428 A 8/1996 Kuroda et al.
5,649,372 A 7/1997 Souza
5,887,456 A 3/1999 Tanigawa et al.
5,940,988 A 8/1999 Eisen
6,154,978 A * 12/2000 Slutsky ..... 34/321
6,158,148 A 12/2000 Krausch
6,334,267 B1 1/2002 Slutsky
6,575,228 B1 * 6/2003 Ragland et al. ..... 165/54
6,671,977 B2 * 1/2004 Beaumont ..... 34/79
6,725,732 B1 4/2004 Stein
6,779,279 B2 8/2004 Lee et al.
6,785,981 B1 9/2004 Harpenau
6,792,694 B2 * 9/2004 Lapierre ..... 34/446
6,845,290 B1 1/2005 Wunderlin et al.
6,868,621 B1 3/2005 Grimm et al.
7,013,578 B2 3/2006 Wunderlin et al.
7,040,039 B1 5/2006 Stein et al.
7,134,221 B2 11/2006 Stein et al.
7,322,126 B2 1/2008 Beaulac
7,337,553 B2 3/2008 Stein et al.
7,478,486 B2 1/2009 Wunderlin et al.
7,811,349 B2 * 10/2010 Nguyen ..... 55/426
2002/0023368 A1 * 2/2002 Beaumont ..... 34/79
2003/0089138 A1 5/2003 Kawamura et al.
2003/0230005 A1 12/2003 Lapierre
2004/0006886 A1 1/2004 Lee et al.
2004/0159008 A1 8/2004 Harpenau
2004/0187343 A1 * 9/2004 Beaumont ..... 34/544
2004/0200093 A1 10/2004 Wunderlin et al.
2006/0086000 A1 * 4/2006 Lee ..... 34/524
2006/0137215 A1 6/2006 Stein et al.
2006/0191161 A1 8/2006 Wunderlin et al.
2006/0218812 A1 10/2006 Brown
2006/0242858 A1 11/2006 Beaulac
2006/0272177 A1 12/2006 Pezier et al.
2006/0288605 A1 12/2006 Carow et al.
2006/0288608 A1 12/2006 Carow et al.
2007/0039198 A1 * 2/2007 Boettcher et al. ..... 34/131
2007/0101603 A1 * 5/2007 Beaumont ..... 34/85
2007/0107250 A1 5/2007 Gassmann et al.
2007/0124954 A1 6/2007 Stein et al.
2007/0124955 A1 6/2007 Crnkovich
2007/0144031 A1 6/2007 Lee
2007/0256322 A1 11/2007 Kim et al.
2008/0005924 A1 1/2008 Yoo et al.
2008/0034611 A1 2/2008 Carow et al.
2008/0047091 A1 * 2/2008 Nguyen ..... 15/300.1
2008/0052951 A1 3/2008 Beaulac
2008/0052954 A1 3/2008 Beaulac
2008/0072448 A1 3/2008 Hubig et al.
2008/0072450 A1 * 3/2008 Kim et al. ..... 34/524
2008/0078100 A1 4/2008 Kim et al.
2008/0098615 A1 5/2008 Kim
2008/0141557 A1 6/2008 Son et al.
2008/0141734 A1 6/2008 Son et al.
2008/0148592 A1 6/2008 Kim et al.
2008/0148597 A1 6/2008 Kim et al.
2008/0184585 A1 8/2008 Yoo et al.
2008/0276484 A1 11/2008 Dewald et al.
2008/0282568 A1 11/2008 Oh et al.
2008/0307667 A1 12/2008 Ikemizu
2008/0313921 A1 12/2008 Oh et al.
2008/0313923 A1 12/2008 Oh et al.
2009/0064528 A1 3/2009 Kim
2009/0100702 A1 * 4/2009 Fair ..... 34/487
2009/0126220 A1 * 5/2009 Nawrot et al. ..... 34/497
2009/0139110 A1 6/2009 Oh et al.
2009/0145001 A1 6/2009 Oh et al.
2009/0172969 A1 7/2009 Kim
2009/0211108 A1 8/2009 Moschutz et al.
2009/0211111 A1 8/2009 Kim et al.
2009/0249639 A1 10/2009 Kim et al.
2009/0255142 A1 10/2009 Brown
2009/0260256 A1 10/2009 Beaulac
2009/0265883 A1 * 10/2009 Reed, Jr. et al. ..... 15/353
2009/0282641 A1 * 11/2009 Black et al. ..... 15/352
2010/0000118 A1 1/2010 Cunningham
2010/0024243 A1 2/2010 Ricklefs et al.
2010/0050464 A1 3/2010 Krzelowski et al.
2010/0058611 A1 3/2010 Neumann

FOREIGN PATENT DOCUMENTS

CN 1467013 1/2004
CN 1766218 5/2006
DE 3930727 3/1991
DE 40 34 273 4/1992
DE 197 04 213 9/1998
DE 19728197 1/1999
DE 29824834 11/2002
DE 10 2004 021 019 11/2005
EP 0 106 289 4/1984
EP 0 512 940 11/1992
GB 2151454 A * 7/1985
JP 53011349 A * 2/1978
JP 53011350 A * 2/1978
JP 54095466 A * 7/1979
JP 54158754 A * 12/1979
JP 55087940 A * 7/1980
JP 55097416 A * 7/1980
JP 56056553 A * 5/1981
JP 56075058 A * 6/1981
JP 56144722 A * 11/1981
JP 57172136 A * 10/1982
JP 58004621 A * 1/1983
JP 58126212 A * 7/1983
JP 59115919 A * 7/1984
JP 60240989 A * 11/1985
JP 61110827 A * 5/1986
JP 61201557 A * 9/1986
JP 62038231 A * 2/1987
JP 62046122 A * 2/1987
JP 62087728 A * 4/1987
JP 62130339 A * 6/1987
JP 62168945 A * 7/1987
JP 63264272 A * 11/1988
JP 01049370 A * 2/1989
JP 01272992 A * 10/1989
JP 02131146 A * 5/1990
JP 02197756 A * 8/1990
JP 03-085199 4/1991
JP 03104678 A * 5/1991
JP 03-280999 12/1991
JP 04-126199 4/1992
JP 4-222611 8/1992
JP 04-325199 11/1992
JP 05-161793 6/1993
JP 05284828 A * 11/1993
JP 6-190196 7/1994
JP 6-281339 10/1994
JP 07101076 A * 4/1995
JP 07322942 A * 12/1995
JP 08066228 A * 3/1996

| | | | | |
|---|---|---|---|---|
| JP | 08178273 | A | * | 7/1996 |
| JP | 08299583 | A | * | 11/1996 |
| JP | 09089247 | A | * | 4/1997 |
| JP | 09191756 | A | * | 7/1997 |
| JP | 09313798 | A | * | 12/1997 |
| JP | 10111979 | A | * | 4/1998 |
| JP | 10165913 | A | * | 6/1998 |
| JP | 10272300 | A | * | 10/1998 |
| JP | 10277323 | A | * | 10/1998 |
| JP | 10334313 | A | * | 12/1998 |
| JP | 11-9899 | | | 1/1999 |
| JP | 11019442 | A | * | 1/1999 |
| JP | 11-137897 | | | 5/1999 |
| JP | 2006026075 | A | * | 2/2006 |
| JP | 2006-55381 | | | 3/2006 |
| JP | 2008044686 | A | * | 2/2008 |
| JP | 2009284669 | A | * | 12/2009 |
| KR | 1998-016229 | | | 5/1998 |
| KR | 10-2004-0085809 | | | 10/2004 |
| WO | WO 2004100757 | A1 | * | 11/2004 |
| WO | WO 2007023209 | A1 | * | 3/2007 |
| WO | WO 2008013258 | A1 | * | 1/2008 |

OTHER PUBLICATIONS

Canadian Office Action dated Jun. 3, 2009.
Chinese Office Action dated Oct. 16, 2009.
U.S. Office Action U.S. Appl. No. 11/849,531 issued Apr. 15, 2010.

* cited by examiner

DRYER WITH CLOGGING DETECTING FUNCTION

TECHNICAL FIELD

The present invention relates to a dryer, and more particularly, to a dry with clogging detecting function which can check and display a clogging degree of an air passage.

BACKGROUND ART

In general, a washing machine with a drying function includes a main body formed in a predetermined shape, a drum installed in the main body, a tub for surrounding the drum and collecting the wash water, a driving motor for rotating the drum, a detergent container for supplying a detergent, a water supply tube connected to the detergent container, for supplying the wash water only or the wash water mixed with the detergent of the detergent container, a drain tube for externally discharging the wash water used in washing, and a pump and a drain hose connected to the end of the drain tube, for forcibly discharging the wash water.

In the washing machine with the drying function, after the laundry and the wash water are put into the drum, the drum is rotated so that the laundry can be dropped in the gravity direction and washed by friction with the wash water. Recently, the drum type washing machine does not only wash the laundry but also dries the laundry by the hot air.

The washing machines with the drying function are classified into a condensation type washing machine and an exhaust type washing machine. In the condensation type washing machine, the hot air generated by a heater is sent to a drum by a ventilation fan, for drying the laundry in the drum. After drying the laundry, the air in the drum becomes the high temperature high humidity air and flows to an exhaust hole communicating with a tub. A nozzle for spraying the cold water is installed at one side of the exhaust hole, for removing moisture from the high temperature high humidity air, and supplying the dry air to the ventilation fan again.

In the exhaust type washing machine, the hot air generated by a heater and a ventilation fan is passed through the laundry in a drum, and externally exhausted from the washing machine through an exhaust hole formed at one side of the washing machine. The exhaust hole is linked to a corrugated hose connected to a tub. In case a baby or a pet is kept shut up in the washing machine, the exhaust hole serves as a vent hole.

When the exhaust type washing machine with the drying function dries the laundry, lint (fine fluff) is generated from the laundry. The lint is circulated with the hot air in the drum of the washing machine, and externally discharged from the washing machine through the exhaust hole.

A structure for periodically collecting the lint generated from the laundry after washing is provided to prevent the lint from being accumulated on the exhaust hole of the washing machine. That is, a lint filter is mounted in the exhaust hole to prevent the lint from clogging up the exhaust hole in long time use of the washing machine.

In the conventional dryer, the exhaust hole passes through an outer wall. The initial state of the exhaust hole (in installation) passing through the outer wall is not checked. Therefore, an installer must arbitrarily judge whether the exhaust hole satisfies the minimum specification for the operation of the dryer.

The conventional dryer recommends filter cleaning in every use. However, the user does not carefully clean the filter due to inconvenience and complication of filter cleaning. The filter is gradually clogged by repeated drying, which increases the drying time or power consumption. When the filter is seriously clogged up, fine lint is not collected in the filter but floats and sticks to the laundry and the dryer and contaminates the laundry. Moreover, in the case of the exhaust type dryer, if the lint clogs the exhaust hole for externally exhausting the used air and interrupts flow of the air, the user cannot easily check clogging of the exhaust hole.

In addition, the conventional dryer can decide or check clogging of the exhaust hole, but cannot provide any information on the current clogging degree of the exhaust hole or the air passage.

DISCLOSURE OF THE INVENTION

The present invention is achieved to solve the above problems. An object of the present invention is to provide a dry with clogging detecting function and a clogging detecting method which can precisely judge a clogging degree of an air passage.

Another object of the present invention is to provide a dryer with clogging detecting function and a clogging detecting method which can display a current state of an air passage to the user, by checking a clogging degree and clogged part information of the air passage.

Yet another object of the present invention is to provide a dry with clogging detecting function and a clogging detecting method which can provide clogging information of an air passage according to execution of a drying operation or an environmental change such as house moving and cleaning.

Yet another object of the present invention is to provide a control panel for a dryer which enables check and display of clogging information of an air passage by a command of the user.

In order to achieve the above-described objects of the invention, there is provided a dry with clogging detecting function, including: a judgment unit for judging a clogging degree of an air passage; a storing unit for storing the clogging degree of the air passage; and a display unit for displaying the clogging degree to the user. The dryer does not only notify clogging of the air passage but also provides information on the clogging degree, so that the user can precisely check the state of the air passage.

The display unit displays the clogging degree by at least two steps, so that the user can check the clogging degree of the air passage increased or decreased step by step.

When the clogging degree is over a critical step, the display unit displays a warning message. In case the air passage needs to be repaired, the user can be informed of the state of the air passage.

The display unit visibly or audibly displays the clogging degree, so that the user can be informed of the clogging degree in any circumstance.

The display unit displays a clogging degree of a lint filter and a clogging degree of an exhaust duct. Therefore, the dryer does not provide the vague state of the air passage but the detailed clogging states of the lint filter and the exhaust duct.

The dryer includes an input unit for starting the judging operation of the judgment unit according to a judgment command from the user. The user can easily check the clogging degree of the air passage by inputting the command for clogging detection in person.

The dryer includes a storing unit for storing the clogging degree of the air passage. The judged clogging degree of the air passage is stored and used as a data for judging a clogging progressive degree of the air passage.

The dryer includes: an operation unit for performing a drying operation on the air passage; and a stopping unit for stopping the drying operation of the operation unit.

The stopping unit intercepts power supply to the operation unit, and the judgment unit includes a detection unit for detecting on/off of the drying operation by the stopping unit, and a control unit for deciding the clogging degree of the air passage according to the on/off of the drying operation detected by the detection unit. That is, the on/off of the drying operation closely associated with the air passage is used as a data for judging the clogging degree of the air passage.

The dryer includes a connection line for connecting the detection unit to the operation unit or the stopping unit. Even if the detection unit and the operation unit or the stopping unit are more or less distant from each other in the dryer, they can be connected through the connection line, for performing communication.

The stopping unit transmits an off control command to the operation unit according to a temperature of the air passage, and the judgment unit judges the clogging degree of the air passage according to the on/off of the drying operation by the stopping unit. Accordingly, the dryer can easily judge the clogging degree according to the on/off of the drying operation by the off control command generally executed in the dryer without requiring an additional detection means.

The judgment unit checks the clogging degree of the air passage by computing an on/off duty ratio of the drying operation. Therefore, the dryer can precisely rapidly check the clogging degree of the air passage.

The control unit decides the clogging degree of the air passage according to a first off time point of the drying operation by the stopping unit. The dryer can rapidly easily decide the clogging degree without complicated data operations.

The dryer includes an operation unit for performing the drying operation on the air passage, and the judgment unit includes a temperature sensing unit for sensing a temperature of the air passage, and a control unit for deciding the clogging degree of the air passage according to a temperature variation sensed by the temperature sensing unit. The dryer can precisely decide the clogging degree of the air passage according to the temperature variation by the air passage flow closely associated with the air passage.

The dryer further includes a comparison unit for comparing the judged clogging degree with at least one prestored clogging degree of the air passage, and the display unit displays the comparison result. Accordingly, the dryer can judge the progressive degree of the clogging state of the air passage by increase of the using frequency of the dryer.

The dryer includes an initial state setting unit for setting the judged clogging degree as an initial clogging degree, when a difference value between the judged clogging degree and the initial clogging degree of the prestored clogging degrees does not correspond to an initial difference value reference range as the comparison result of the comparison unit. Therefore, the dryer can judge the clogging progressive degree of the air passage.

The dryer includes an initial state setting unit for setting the judged clogging degree as an initial clogging degree, when the prestored clogging degree does not exist. After firstly judging the clogging degree of the dryer, the dryer stores this value as the initial state of the air passage.

The initial clogging degree is the clogging degree of the exhaust duct. When the dryer is firstly installed, the air passage in the dryer is not at all clogged. This clogging degree is judged as the clogging degree of the exhaust duct.

The dryer includes a setting unit for setting a comparison result of the comparison unit between the judged clogging degree and the latest stored clogging degree as the clogging degree or clogging progressive degree of the lint filter. Accordingly, the dryer can judge the clogging degree or clogging progressive degree of the lint filter more slowly increased or decreased than that of the exhaust duct.

The dryer includes: a first comparison unit for comparing the judged clogging degree with a clogging reference of the exhaust duct; and a second comparison unit for comparing a difference value between the prestored clogging degree and the judged clogging degree with a clogging reference of the lint filter. The dryer preferentially judges the clogging degree of the exhaust duct.

The dryer includes a display unit for displaying clogging of the exhaust duct or clogging of the lint filter according to the comparison result of the first comparison unit or the second comparison unit. As a result, the user can check clogging of the exhaust duct and clogging of the lint filter, respectively.

In another aspect of the present invention, there is provided a control panel for a dryer, including: an input unit for acquiring a judgment request for a clogging degree of an air passage from the user; and a display unit for displaying the clogging degree of the air passage according to the judgment request. The user can input the judgment request for the clogging degree of the air passage in person in a wanted time, and check the clogging degree of the air passage.

The display unit visibly or audibly displays the clogging degree.

The display unit displays the clogging degree by at least two steps.

When the clogging degree is over a critical step, the display unit displays a warning message.

The display unit displays a clogging degree of a lint filter and a clogging degree of an exhaust duct.

In yet another aspect of the present invention, there is provided a clogging detecting method for a dryer, including: a step to judge a clogging degree of an air passage; when an initial clogging degree has been prestored, a step to compare the judged clogging degree with the initial clogging degree; when a difference value between the judged clogging degree and the initial clogging degree does not correspond to an initial difference value reference range as the comparison result, a first storing step to store the judged clogging degree as a new initial clogging degree; and when the initial clogging degree has not been stored, a second storing step to store the judged clogging degree as the initial clogging degree. After the dryer is installed in a specific space, the clogging degrees of the air passage are checked and stored according to first or repeated use of the dryer.

The clogging detecting method for the dryer includes a step to display the initial clogging degree, so that the user can recognize the initial clogging degree of the air passage.

The initial clogging degree is a clogging degree of an exhaust duct, and the difference value is a clogging progressive degree of the exhaust duct.

The clogging detecting method for the dryer includes a third storing step to store the judged clogging degree, when the difference value between the judged clogging degree and the initial clogging degree corresponds to the initial difference value reference range as the comparison result.

The clogging detecting method for the dryer includes a step to display the difference value, when the difference value between the judged clogging degree and the initial clogging degree corresponds to the initial difference value reference range as the comparison result.

The difference value is a clogging progressive degree of a lint filter, and the sum of the difference values is a clogging degree of the lint filter.

In yet another aspect of the present invention, there is provided a clogging detecting method for a dryer, including: a step to judge a clogging degree of an air passage; a step to compare the clogging degree with a prestored clogging reference of an exhaust duct; and when the clogging degree corresponds to the clogging reference of the exhaust duct in the comparison step, a step to display clogging of the exhaust duct. Therefore, clogging of the exhaust duct can be preferentially judged on the air passage.

The clogging detecting method for the dryer includes: when the clogging degree does not correspond to the clogging reference of the exhaust duct in the comparison step, a second comparison step to compare a difference value between the judged clogging degree and the latest stored clogging degree with a clogging reference of a lint filter; and when the difference value corresponds to the clogging reference of the lint filter in the second comparison step, a step to display clogging of the lint filter.

The clogging detecting method for the dryer includes a step to store the judged clogging degree, when the difference value does not correspond to the clogging reference of the lint filter in the second comparison step.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

A dryer in accordance with the preferred embodiments of the present invention will now be described in detail with reference to the accompanying drawings.

Various claimable aspects of the present invention will now be described. The following description becomes part of the detailed description of the present invention. The following description must be recognized as the technical ideas of the present invention understood in various viewpoints, or the minimum technology for the dryer and the control panel for the dryer according to the present invention, not as a limiting boundary of the present invention.

Figure 1:
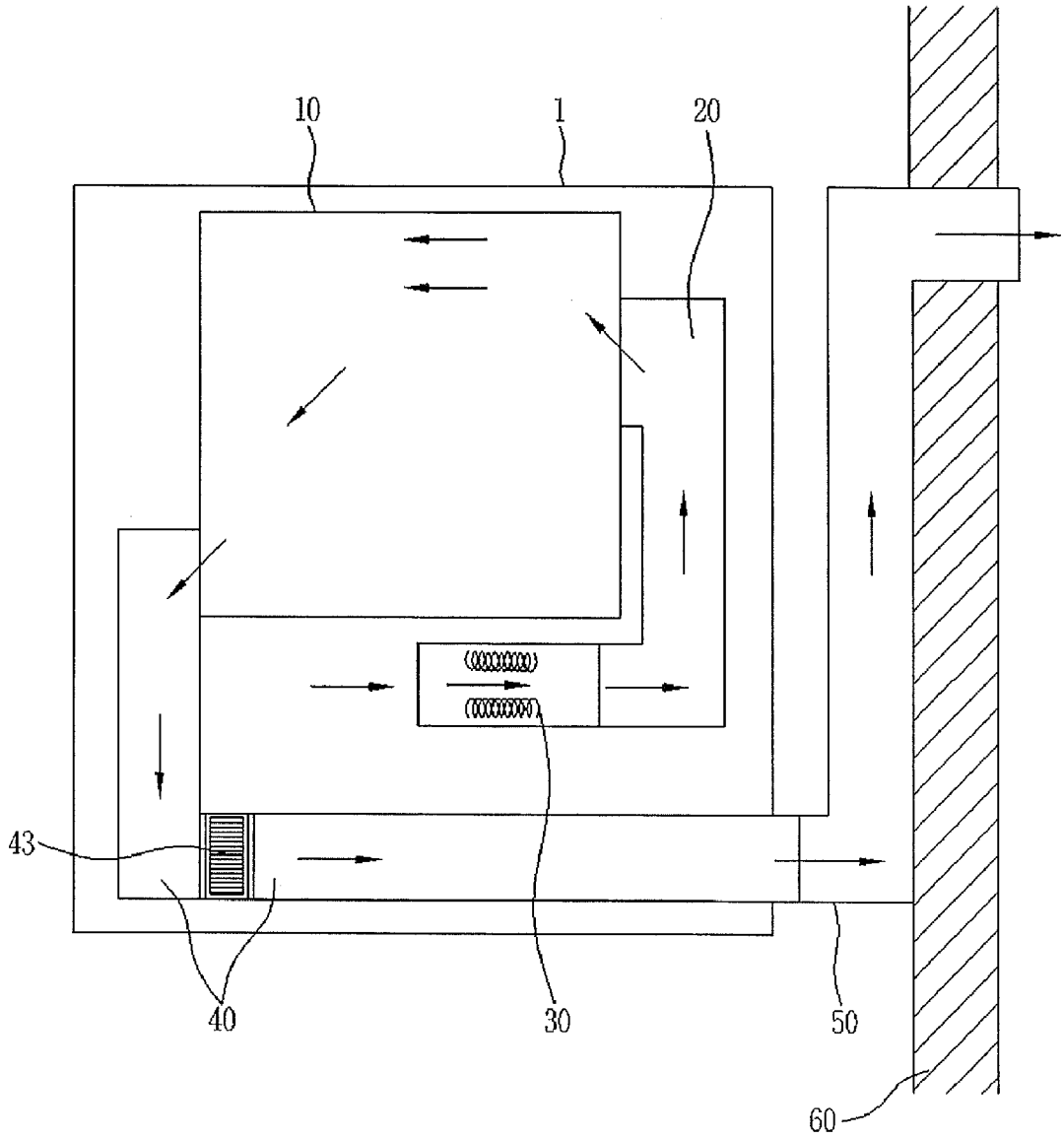
FIG. 1 is a cross-sectional view illustrating a dryer in accordance with the present invention.
Figure 2:
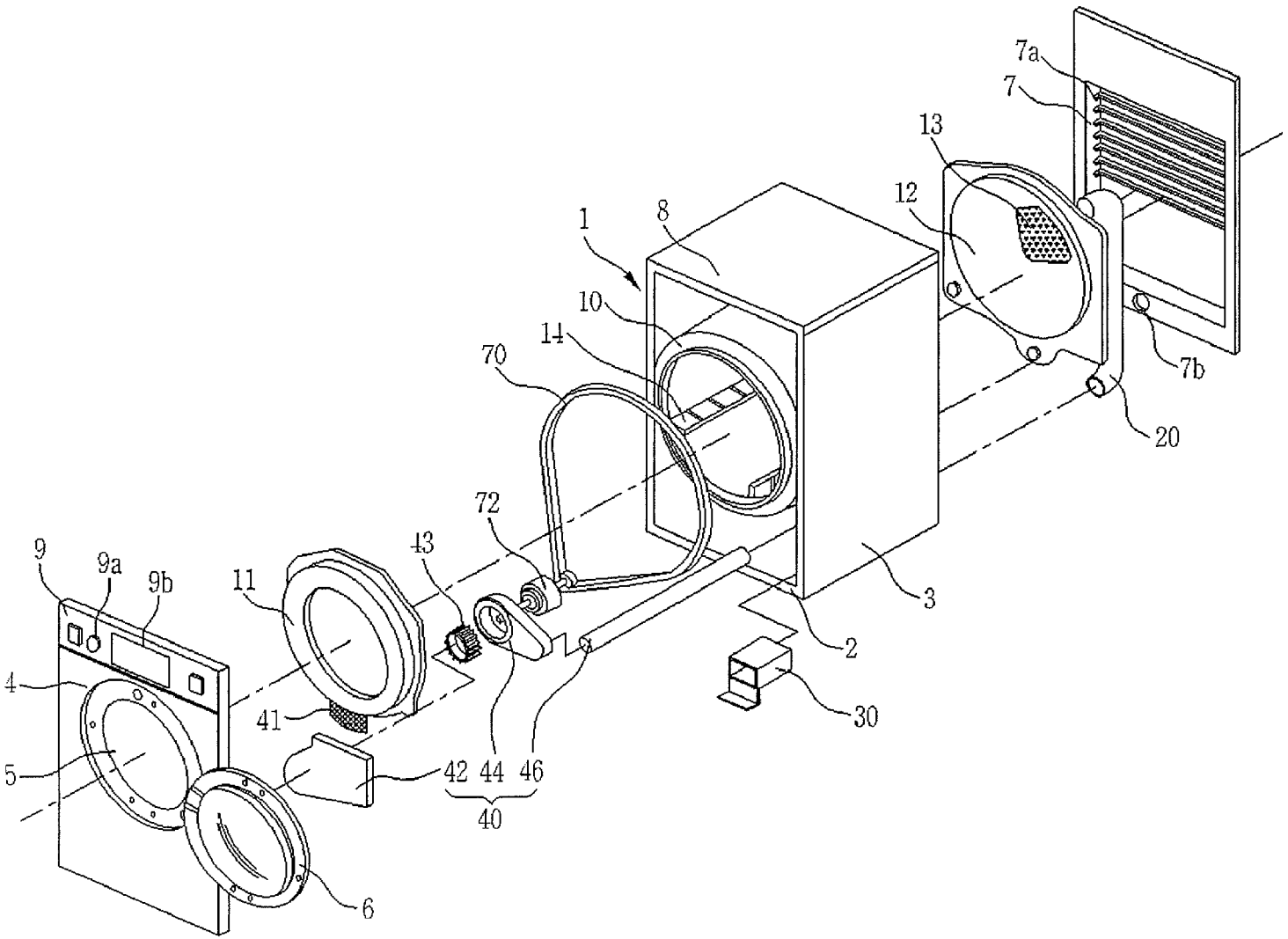
FIG. 2 is an exploded perspective view illustrating the dryer in accordance with the present invention.
Figure 3:
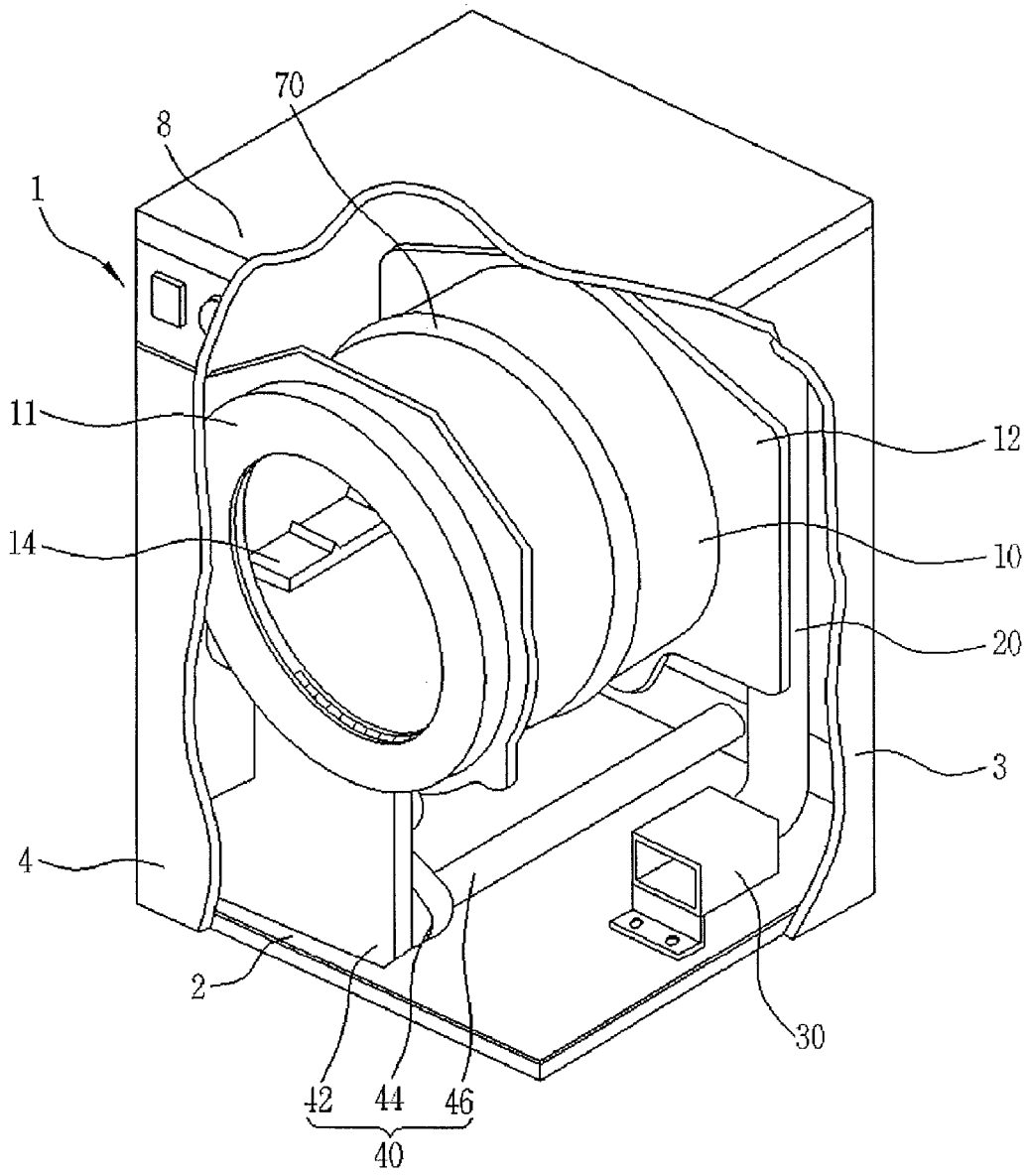
FIG. 3 is a partial cutaway view illustrating the dryer in accordance with the present invention.

FIG. 1 is a cross-sectional view illustrating a dryer in accordance with the present invention, FIG. 2 is an exploded perspective view illustrating the dryer in accordance with the present invention, and FIG. 3 is a partial cutaway view illustrating the dryer in accordance with the present invention. An exhaust type dryer is exemplified below, which is not intended to be limiting.

Referring to FIG. 1, the exhaust type dryer includes a drum 10 disposed in a cabinet 1, for containing the laundry, a suction passage 20 for supplying the air into the drum 10, a heater 30 installed on the suction passage 20, and an exhaust passage 40 for externally exhausting the air passing through the drum 10 from the cabinet 1. In the case of the exhaust type dryer, an exhaust duct 50 is coupled to the exhaust passage 40, for externally exhausting the air through an inner wall 60 of a building.

A ventilation fan 43 is installed at one side of the suction passage 20 or the exhaust passage 40. Hereinafter, it is presumed that the ventilation fan 43 is installed at one side of the exhaust passage 40.

As illustrated in FIGS. 2 and 3, the cabinet 1 includes a base pan 2, a cabinet main body 3 installed at the upper portion of the base pan 2, a cabinet cover 4 installed on the front surface of the cabinet main body 3, a back panel 7 installed on the rear surface of the cabinet main body 3, a top cover 8 installed on the top surface of the cabinet main body 3, and a control panel 9 installed at the top end of the cabinet cover 4.

Still referring to FIG. 2, a laundry inlet 5 for putting the laundry into the drum 10 is formed on the cabinet cover 4, and a door 6 for opening and closing the laundry inlet 5 is rotatably connected to the cabinet cover 4. The control panel 9 is installed at the top end of the cabinet cover 4. The control panel 9 includes an input unit 9*a* for acquiring an input from the user, and a display unit 9*b* for displaying the state of the dryer 1 (for example, the drying processing state, the drying processing degree, the remaining drying time, selection of the drying mode, etc.). A front supporter 11 for rotatably supporting the front end of the drum 10 is mounted at the rear portion of the cabinet cover 4.

A rear supporter 12 for rotatably supporting the rear end of the drum 10 is mounted at the front portion of the back panel 7. A communication hole 13 for making the suction passage 20 and the inlet portion of the drum 10 communicate with each other is formed on the rear supporter 12, so that the air passing through the suction passage 20 can be supplied to the inlet portion of the drum 10.

As shown in FIGS. 2 and 3, the drum 10, which is a cylindrical container for containing the laundry, is opened in the forward and backward directions, so that the air can pass through the drum 10 in the forward and backward directions. The rear opening portion forms the inlet portion of the drum 10, and the front opening portion forms the outlet portion of the drum 10. A lift 14 for lifting and dropping the laundry in rotation of the drum 10 is protruded from the inner circumference of the drum 10.

The suction passage 20 is formed by a suction duct having its bottom end connected to communicate with the rear end of the heater 30 and its top end connected to communicate with the communication hole 13 of the rear supporter 12.

Still referring to FIGS. 2 and 3, the heater 30 installed on the top surface of the base pan 2 includes a heater casing communicating with the suction passage 20, namely, the suction duct 20, and a heat generation coil arranged in the heater casing. When power is supplied to the heat generation coil, the inside space of the heater casing and the heater casing itself are heated so that the air passing through the heater casing can be converted into the high temperature low humidity air.

The exhaust passage 40 is formed by a lint duct 42 communicating with the outlet portion of the drum 10 to exhaust the air from the drum 10, a lint filter 41 for filtering off impurities such as lint from the exhausted air being mounted on the lint duct 42, a fan housing 44 communicating with the lint duct 42 and housing a ventilation fan 43, and an exhaust pipe 46 having its one end connected to communicate with the fan housing 44, and its other end externally elongated from the cabinet 1. The exhaust duct 50 for guiding the air externally exhausted from the cabinet 1 to the outdoor space is connected to the exhaust pipe 46. The exhaust duct 50 is formed outside the cabinet 1, for guiding the air to the outdoor space. The exhaust duct 50 can be installed to pass through the inner wall 60 of the building.

In accordance with the present invention, the air passage includes the suction passage 20, the inside space of the drum 10, the exhaust passage 40 and the exhaust duct 50. Clogging of the air passage mostly occurs in the lint filter 41 of the exhaust passage 40 and the exhaust duct 50. The airflow is relatively less interrupted by clogging of the lint filter 41 of the exhaust passage 40 than clogging of the exhaust duct 50.

The operation of the exhaust type dryer in accordance with the present invention will now be described.

When the user puts the laundry into the drum 10, closes the door 6 and operates the exhaust type dryer by controlling the control panel 9, the exhaust type dryer turns on the heater 30 and drives a motor 72.

When the heater 30 is turned on, the heater 30 heats the inside of the dryer 1, and when the motor 72 is driven, a belt 70 and the ventilation fan 43 are rotated. When the belt 70 is rotated, the drum 10 is rotated. The laundry in the drum 10 is repeatedly lifted and dropped by the lift 14.

When the ventilation fan 43 is rotated, the outdoor air of the cabinet 1 is sucked into an air suction hole 7*a* of the back cover 7 by an air blast force of the ventilation fan 43, and supplied to a gap between the cabinet 1 and the drum 10. The air in the gap between the cabinet 1 and the drum 10 is introduced to the heater 30, heated into the high temperature low humidity air, and sucked into the drum 10 through the suction passage 20 and the communication hole 13 of the rear supporter 12.

The high temperature low humidity air sucked into the drum 10 flows in the forward direction of the drum 10, becomes the high humidity air by contact with the laundry, and is exhausted to the exhaust passage 40.

The air exhausted to the exhaust passage 40 is passed through the exhaust pipe 46, and externally exhausted through the exhaust duct 50.

Figure 4:
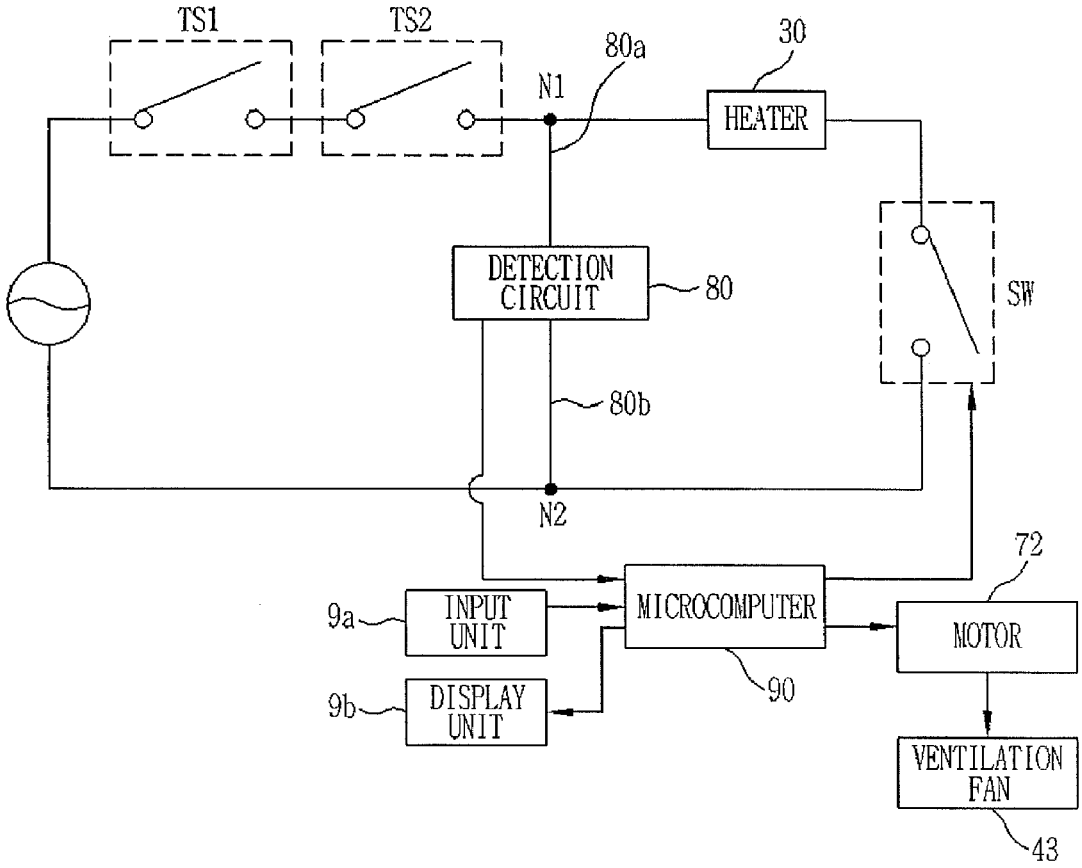
FIG. 4 is a configuration view illustrating a dryer in accordance with a first embodiment of the present invention.

FIG. 4 is a configuration view illustrating a dryer in accordance with a first embodiment of the present invention. As depicted in FIG. 4, the dryer includes first and second thermostats TS1 and TS2 for supplying external common power to the heater 30, the first and second thermostats TS1 and TS2 being turned on/off according to a temperature of the heater 30 or a temperature of the air heated by the heater 30, a switch SW turned on/off by a control command of a microcomputer 90, for applying the common power to the heater 30, the input unit 9*a*, the display unit 9*b*, the heater 30, the ventilation fan 43, the motor 72, a detection circuit 80 for judging power supply to the heater 30 according to on/off of the first and second thermostats TS1 and TS2, and the microcomputer 90 for judging operation possibility of the first and second thermostats TS1 and TS2 according to the power supply state from the detection circuit 80. A power supply unit for supplying DC power from the common power supply source to the microcomputer 90, the input unit 9*a* and the display unit 9*b* is not shown. However, the power supply unit can be easily understood by the ordinary people in the field to which the present invention pertains.

The first and second thermostats TS1 and TS2, which are a kind of temperature control units, are mounted in the side or proximity of the heater 30, and react to the temperature of the heater 30 or the temperature of the air heated by the heater 30. If the temperature does not reach a predetermined overheat temperature, the first and second thermostats TS1 and TS2 are continuously on. If the temperature exceeds the overheat temperature, the first and second thermostats TS1 and TS2 are turned off not to apply the common power to the heater 30. Especially, to complement the second thermostat TS2, once the first thermostat TS1 is turned off, it does not return to the on state. For example, the first and second thermostats TS1 and TS2 are mounted on the suction passage 20 connected to the heater 30.

The switch SW, which is a kind of relay, maintains the on state during the drying operation by the on control of the microcomputer 90, and maintains the off state by the off control of the microcomputer 90.

The input unit 9*a* receives a control command for drying from the user, and applies the control command to the microcomputer 90. In addition, so as to judge the clogging state or degree of the air passage (especially, the exhaust duct 50), the input unit 9*a* acquires a command for state detection of the air passage from the user, and applies the command to the microcomputer 90. The state detection command of the input unit 9*a* can be stored in the microcomputer 90. The input unit 9*a* is formed on the front surface of the control panel 9. However, a special input unit for the state detection command can be installed on the rear surface or at the inner portion of the cabinet main body 3.

The display unit 9*b* displays the user input for the drying operation, the drying processing degree, the remaining drying time, and the clogging degree and clogged part of the air passage. In accordance with the present invention, the air passage includes the suction passage 20, the inside of the drum 10, the exhaust passage 40 and the exhaust duct 50. Especially, the air passage can indicate the lint filter 41 of the exhaust passage 40 and the exhaust duct 50.

The detection circuit 80 is connected to nodes N1 and N2, respectively, for deciding whether current flows in the serial circuit including the heater 30, namely, whether power is supplied to the heater 30. For this, the detection circuit 80 is connected to the nodes N1 and N2 through connection lines 80*a* and 80*b*, respectively. Since the detection circuit 80 is installed on the control panel 9 on which the microcomputer 90 has been mounted, the connection lines 80*a* and 80*b* are laid along the inside space between the drum 10 and the cabinet main body 3 or the inner surface of the cabinet main body 3.

In more detail, the detection circuit 80 judges whether power is supplied to the heater 30 according to the on/off operations of the first and second thermostats TS1 and TS2 by the temperature of the heater 30 or the air. Power supply to the heater 30 can also be controlled by the switch SW operated by the control of the microcomputer 90. When the switch SW is turned on, the microcomputer 90 checks the power supply state according to the signal from the detection circuit 80. When the switch SW is turned off, the microcomputer 90 does not consider the signal from the detection circuit 80.

The detection circuit 80 applies different signals to the microcomputer 90 according to the power supply state, so that the microcomputer 90 can check the power supply state of the heater 30. Differently from FIG. 4, the input terminals of the detection circuit 80 can be connected between the first thermostat TS1 and the common power supply source and between the heater 30 and the switch SW, respectively. In the serial circuit consisting of the common power supply source, the first and second thermostats TS1 and TS2, the heater 30 and the switch SW, a potential difference of both ends of the heater 30 can be most clearly identified according to supply of the common power. Therefore, the detection circuit 80 is connected to always detect the potential difference of the portion including the heater 30.

As described above, the microcomputer 90 performs the drying operation by controlling the heater 30, the switch SW and the motor 72 according to the command of the user from the input unit 9*a*, and operating the ventilation fan 43 by the motor 72. The microcomputer 90 includes a storing unit (not shown) for storing such a control algorithm. For example, an EEPROM can be used as the storing unit.

The microcomputer 90 and the detection circuit 80 are mounted on the rear surface of the control panel 9.

In addition, the microcomputer 90 judges information on power supply and interception by the first and second thermostats TS1 and TS2 according to the detection signal from the detection circuit 80.

Figure 5:
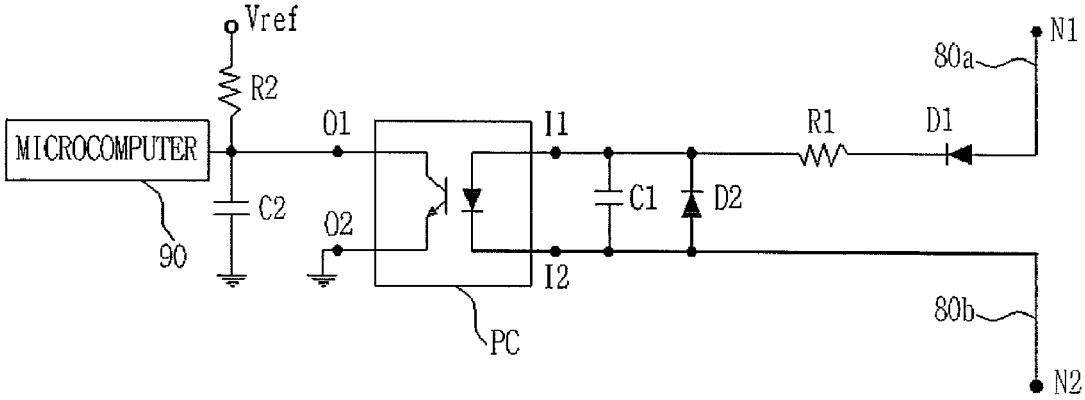
FIG. 5 is a circuit view illustrating a detection circuit of FIG. 4.

FIG. 5 is a circuit view illustrating the detection circuit of FIG. 4. Referring to FIG. 5, the detection circuit 80 includes a diode D1 for applying a positive (+) voltage among the input voltages from the node N1, a resistor R1 for reducing the input voltage from the node N1, a diode D2 and a capacitor C1 for preventing noise contained in the input voltage applied to input terminals I1 and I2 of a photocoupler PC, the photocoupler PC turned on/off according to the input voltage, and a resistor R2 and a capacitor C2 connected to an output terminal O1 of the photocoupler PC, for supplying different voltage waveforms below a reference voltage Vref which is a DC voltage to the microcomputer 90 according to on/off of the photocoupler PC. The reference voltage Vref is used as a driving voltage of the microcomputer 90 in the circuit including the microcomputer 90. Explanations of a power supply unit for generating the reference voltage Vref are omitted. Generation of the reference voltage Vref can be easily recognized by the ordinary people in the field to which the present invention pertains.

For example, when the common power is AC 240V, the potential difference between the nodes N1 and N2 is about 240V. If this voltage is applied to the photocoupler PC as it is, it may damage the photocoupler PC. The resistor R1 is provided to reduce the input voltage into a few tens V.

If the potential difference exists between the nodes N1 and N2, namely, if the first and second thermostats TS1 and TS2 are turned on to supply power to the heater 30, a voltage corresponding to the potential difference is applied to the input terminals of the photocoupler PC. Because the voltage is an AC voltage, an inside photodiode emits light according to the period of the voltage, and a transistor which is a light receiving unit is turned on/off, for applying a square wave to the microcomputer 90. If the potential difference does not exist between the nodes N1 and N2, namely, if the first and second thermostats TS1 and TS2 are turned off not to supply power to the heater 30, the input terminals of the detection circuit 80 have the same potential. Accordingly, the inside photodiode does not emit light, and the transistor which is the light receiving unit is turned off, for continuously applying DC voltage waveforms approximate to the reference voltage Vref to the microcomputer 90.

Figure 6:
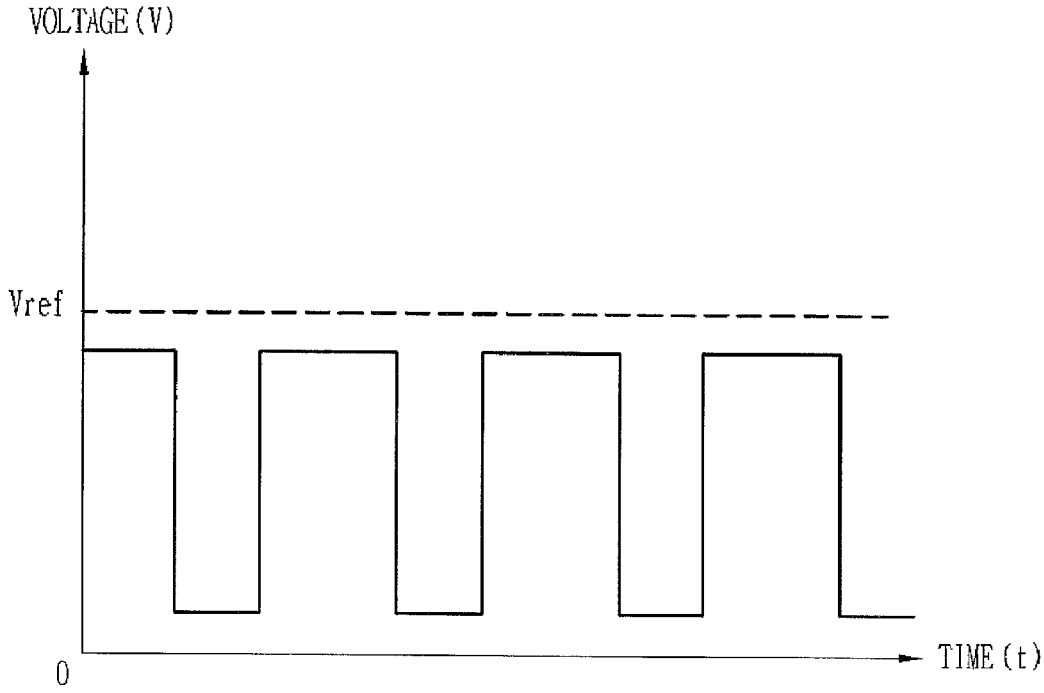
FIGS. 6 and 7 are graphs showing output waveforms of the detection circuit.
Figure 7:
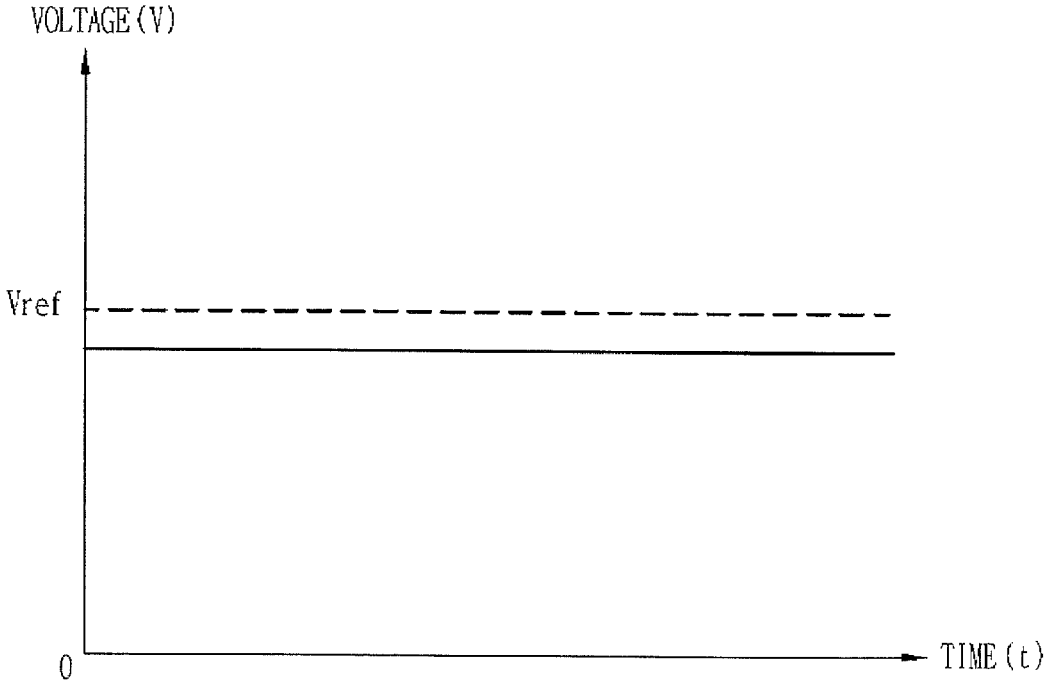

FIGS. 6 and 7 are graphs showing output waveforms of the detection circuit. As shown in FIG. 6, when the first and second thermostats TS1 and TS2 are turned on, the common power which is the AC voltage is applied to the heater 30. A voltage difference equivalent in size to the common power is generated between the nodes N1 and N2. The photocoupler PC is turned on due to the voltage difference. Since the common power is the AC voltage, the photocoupler PC is repeatedly turned on/off according to the period of the common power, thereby applying the square wave smaller than the reference voltage Vref to the microcomputer 90.

As depicted in FIG. 7, when the first or second thermostat TS1 or TS2 is turned off, power is not supplied to the heater 30. The nodes N1 and N2 have the same potential. As a result, the photocoupler PC is always turned off, thereby applying the DC voltage (for example, high signal) approximate to the reference voltage Vref to the microcomputer 90.

Therefore, the microcomputer 90 can compute the power interception time of the heater 30 by the off states of the first and second thermostats TS1 and TS2 according to the waveform of the applied DC voltage.

Figure 8:
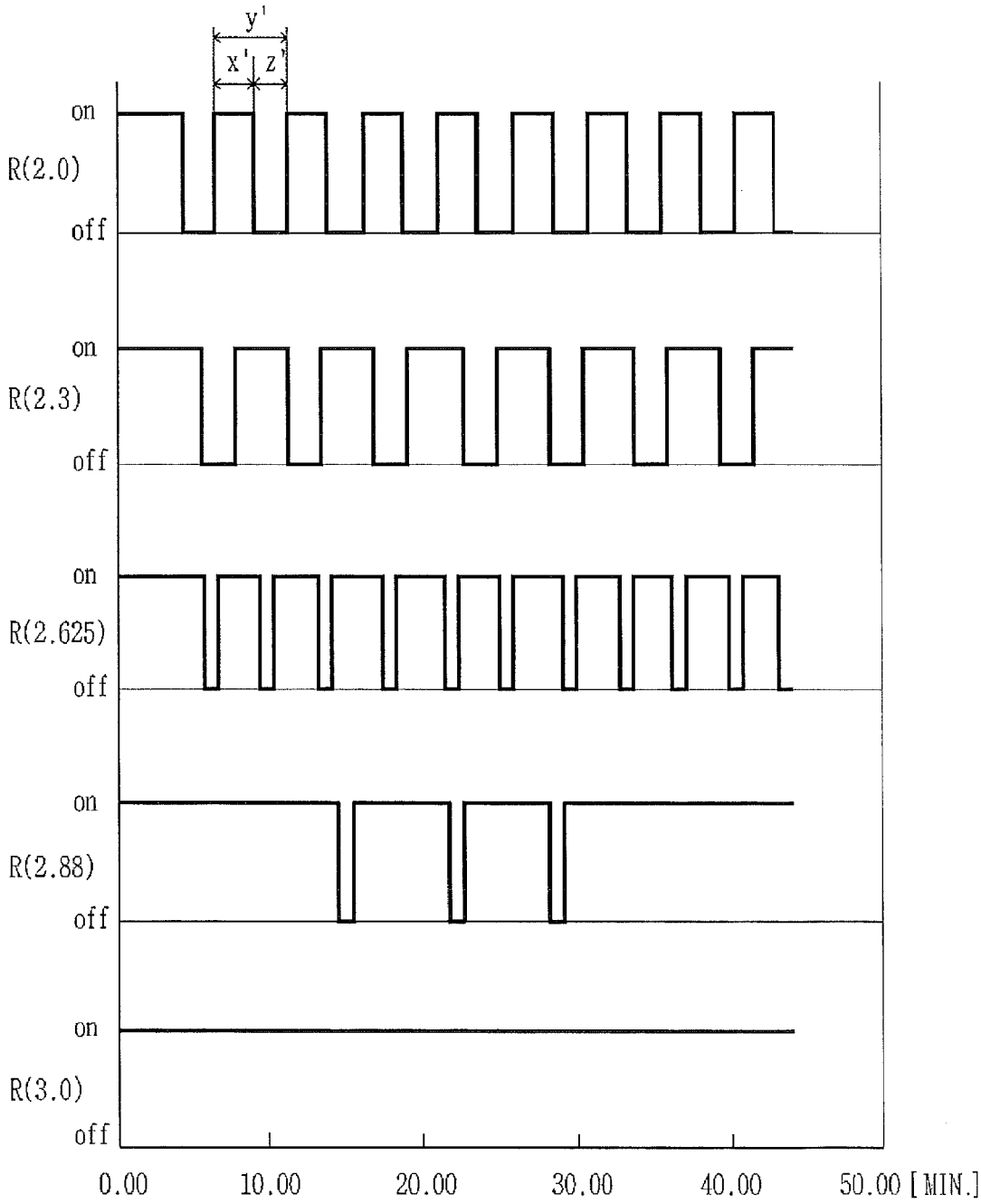
FIG. 8 is a graph showing on/off recognized by a microcomputer.

FIG. 8 is a graph showing on/off recognized by the microcomputer of FIG. 5. In FIG. 8, R represents a diameter of the exhaust duct 50, and the used unit is inch. That is, when the diameter of the exhaust duct 50 is R(2.0), R(2.3), R(2.625), R(2.88) and R(3.0), the microcomputer 90 recognizes on/off of power supply to the heater 30 according to the signal from the detection circuit 80 of FIGS. 6 and 7. If the diameter is large, the state (clogging degree or clogging progressive degree) of the air passage is weak, and if the diameter is small, the state (clogging degree or clogging progressive degree) of the air passage is serious.

A method for checking a first off time point of power supply to the heater 30 by the off state of the switch SW is suggested to check the state of the air passage.

According to the comparison result of the first off time point t1 of R(0), the first off time point t2 of R(1.0), the first off time point t3 of R(1.5), the first off time point t4 of R(2.0) and the first off time point t5 of R(2.625), the smaller the diameter is, the more slowly the first off state is progressed. When the diameter is small, the quantity of the air exhausted through the air passage (especially, the exhaust duct 50) is reduced, and an ambient temperature of a temperature sensor 82*a* is slowly raised. In this experiment, the diameter corresponds to the clogging state of the air passage. If the diameter is large, the air passage is less clogged, and if the diameter is small, the air passage is more clogged. As described above, the microcomputer 90 can decide the state of the air passage by checking the first off time point according to the recognized data, such as the on/off graph of FIG. 8.

A method for computing an on/off duty ratio of power supply is suggested to decide the clogging state of the air passage. In this embodiment, one or both of the on duty ratio (x'/y') and the off duty ratio (z'/y') can be used. Here, the off duty ratio (z'/y') is explained.

The off duty ratio of R(2.0) is 0.48 (the on duty ratio thereof is 0.52), the off duty ratio of R(2.3) is 0.32 (the on duty ratio thereof is 0.68), the off duty ratio of R(2.625) is 0.26 (the on duty ratio thereof is 0.74), the off duty ratio of R(2.88) is 0.13 (the on duty ratio thereof is 0.87), and the off duty ratio of R(3.0) is 0 (the on duty ratio thereof is 1). That is, the smaller the diameter is, the higher the off duty ratio is. The on duty ratio relatively increases. Therefore, the microcomputer 90 can decide the current clogging degree of the air passage (especially, the clogging state of the lint filter 41 or the exhaust duct 50) by computing the off duty ratio.

Figure 9:
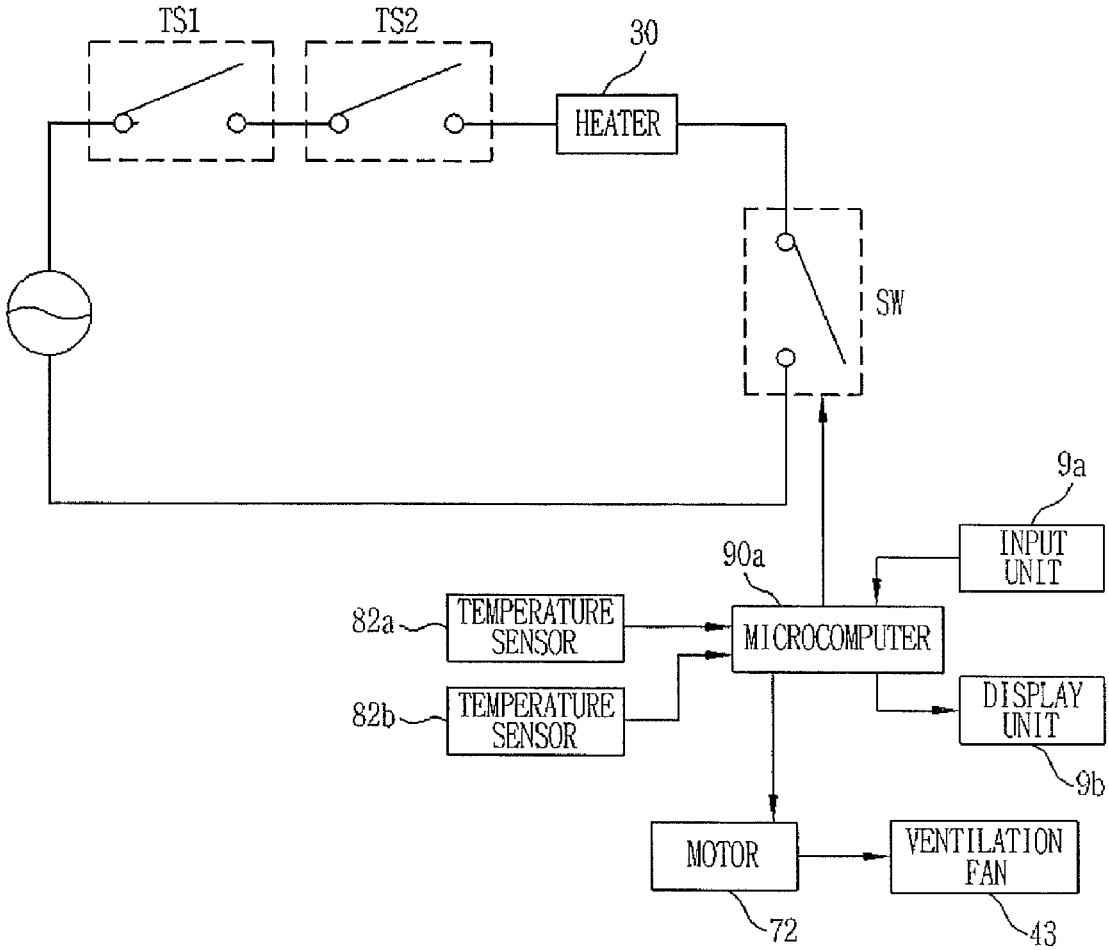
FIG. 9 is a configuration view illustrating a dryer in accordance with a second embodiment of the present invention.

FIG. 9 is a configuration view illustrating a dryer in accordance with a second embodiment of the present invention. As different from the dryer of FIG. 4, the dryer of FIG. 9 does not include the detection circuit 80, but includes temperature sensors 82*a* and 82*b* for sensing an air temperature in the air passage, and a microcomputer 90*a* for checking the state of the air passage. Constitutional elements with same names and numbers perform same functions.

The temperature sensor 82*a*, which senses the temperature of the exhaust passage 40, can be a thermostat. To sense the temperature of the air passing through the lint filter 41, the temperature sensor 82*a* is mounted at the rear end of the lint filter 41 on the exhaust passage 40. Since the exhaust passage 40 and the exhaust duct 50 communicate with each other, although the temperature sensor 82*a* is mounted on the exhaust passage 40 behind the lint filter 41, the temperature sensor 82*a* can sense the most approximate temperature to the temperature of the exhaust duct 50. The temperature sensor 82*b* is provided to sense the temperature inside the drum 10 (for example, water temperature, air temperature, etc.). Hereinafter, the temperature sensors 82*a* and 82*b* can be referred to as the temperature sensor 82.

In order to maintain the temperature of the exhaust passage 40 within a predetermined range (for example, 100 to 110° C.), the microcomputer 90*a* controls heat generation of the heater 30 by turning on/off the switch SW according to the temperature sensed by the temperature sensor 82*a*.

The microcomputer 90*a* uses the following state. For example, if the air passage (especially, the exhaust duct 50 or the lint filter 41) is seriously clogged up, since the air flow from the outdoor space is not smooth, the temperature of the heater 30 or the temperature of the air heated by the heater 30 is raised to influence the first and second thermostats TS1 and TS2 (hereinafter, referred to as 'temperature control unit'). However, the temperature sensed by the temperature sensor 82*a* is relatively slowly raised because the air flow is not smooth. The microcomputer 90*a* checks the state of the air passage by using the fact that the on/off control for the switch SW is changed according to the state of the air passage. Here, the state of the air passage includes the clogging degree and the clogged part location of the air passage. For example, if the lint filter 41 is more or less clogged, the clogging degree is weak, and if the exhaust duct 50 is clogged, the clogging degree is serious.

When the clogging degree of the air passage is weak, the air temperature influencing the temperature control unit is rarely different from the temperature sensed by the temperature sensor 82*a*. Even if the temperature is continuously raised, before the temperature control unit intercepts power, the microcomputer 90*a* controls off of the switch SW.

Conversely, when the clogging degree of the air passage is serious, the air temperature influencing the temperature control unit is much higher than the temperature sensed by the temperature sensor 82*a*. Before the microcomputer 90*a* controls the switch SW, the temperature control unit is automatically turned off. Accordingly, the microcomputer 90*a* controls the switch SW after a long time only when the air temperature of the exhaust passage 40 exceeds a predetermined range. However, when the microcomputer 90*a* checks the state of the air passage after the first use of the dryer 1 or the cleaning of the lint filter 41, the microcomputer 90*a* checks the state (clogging) of the exhaust duct 50.

Figure 10:
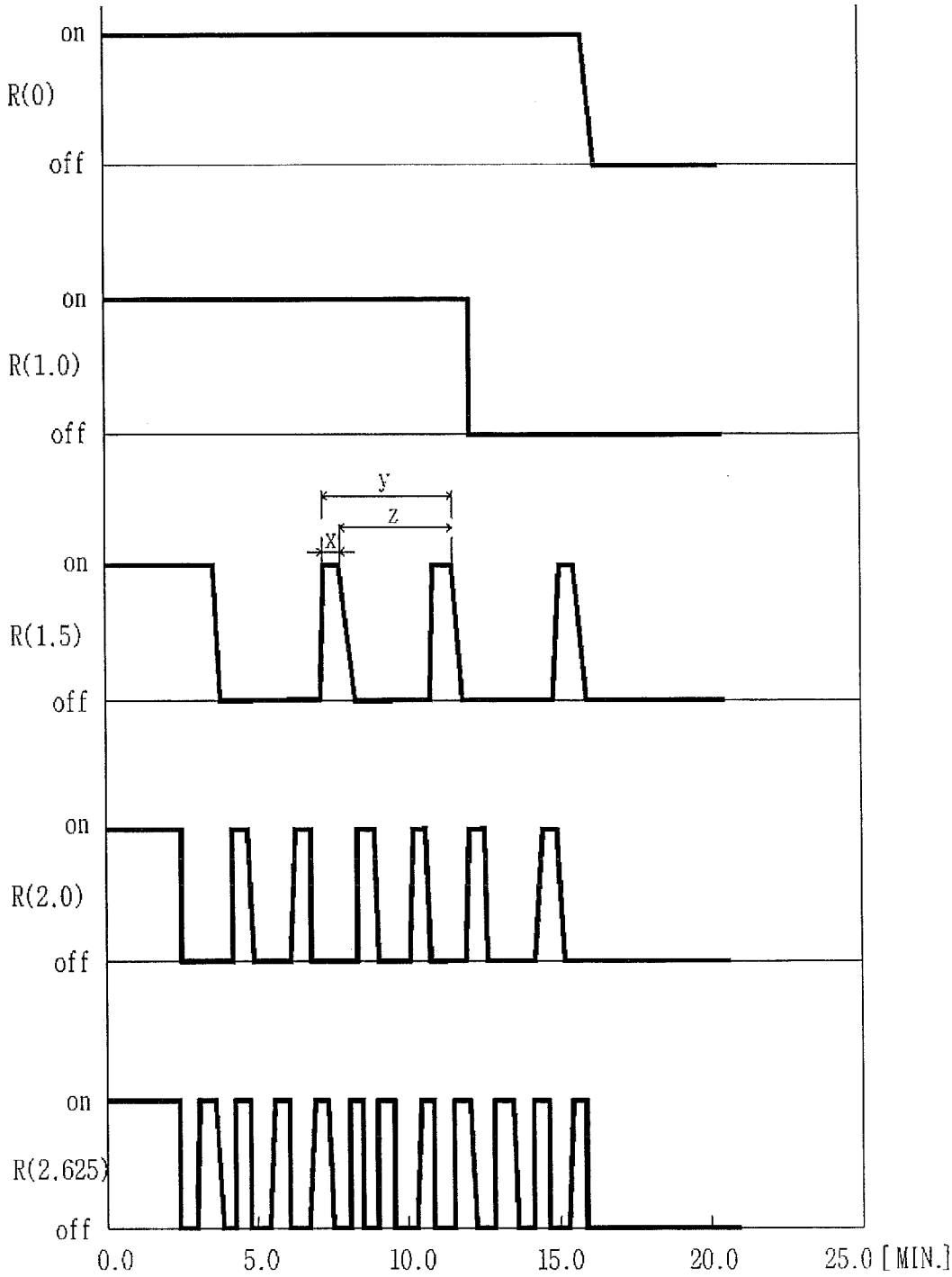
FIG. 10 is a graph showing on/off of a drying operation by temperature recognized by a microcomputer of FIG. 9.

FIG. 10 is a graph showing on/off of the drying operation by temperature recognized by the microcomputer of FIG. 9. In FIG. 10, R represents a diameter of the exhaust duct 50, and the used unit is inch. In the case that the diameter of the exhaust duct 50 is R(0), R(1.0), R(1.5), R(2.0) and R(2.625), the microcomputer 90*a* turns on/off the switch SW according to the temperature sensed by the temperature sensor 82*a*. If the diameter is large, the state (clogging degree) of the air passage is weak, and if the diameter is small, the state (clogging degree) of the air passage is serious.

A method for computing an on/off duty ratio of power supply is suggested to check the state of the air passage. In this embodiment, one or both of the on duty ratio (x/y) and the off duty ratio (z/y) can be used. Table 1 shows the states of the air passage according to the experiment results including the graph of FIG. 10.

TABLE 1

| Off duty ratio | Clogging degree | Clogged part |
|---|---|---|
| 0~0.30 | — | — |
| 0.30~0.45 | Low (weak) | Lint filter |
| 0.45~0.60 | Middle | Lint filter |
| 0.60~ | High (serious) | Exhaust duct |

The microcomputer 90*a* stores the lookup table such as Table 1, computes the off duty ratio (or the on duty ratio) reflecting the on/off control characteristic of the switch SW during the drying operation, and compares the lookup table with the prestored lookup table, thereby checking the clogging state (clogging degree, clogged part, etc.) of the corresponding region.

In addition, the microcomputer 90*a* stores the currently checked state of the air passage, and displays the state of the air passage through the display unit 9*b*. In installation of the dryer 1, the microcomputer 90*a* notifies successful installation to the user (or installer). That is, when the clogging degree of the air passage is serious, the microcomputer 90*a* displays a message of requiring re-installation of the dryer 1, or a message of requiring additional wall perforation on the outer wall to widen the exhaust duct 50.

The currently checked state of the air passage is influenced by the through hole of the outer wall. The clogging degree of the air passage checked after initial installation of the dryer 1 or cleaning of the lint filter 41 gets more serious due to use of the dryer 1. Therefore, the microcomputer 90*a* uses the currently checked state of the air passage as a reference state or an offset value.

In the case that the microcomputer 90*a* uses the currently checked state of the air passage as the reference state (initial clogging degree), the microcomputer 90*a* checks the state of the air passage in each drying operation automatically or according to the state check command from the user, and compares the state of the air passage with the prestored state of the air passage, thereby deciding the current state of the air passage.

In the case that the microcomputer 90*a* uses the currently checked state of the air passage as the offset value, the microcomputer 90*a* performs the drying operation by changing the drying algorithm by reflecting the current state of the air passage. That is, the microcomputer 90*a* can reflect the state of the air passage to the control temperature of the switch SW, the drying time, etc. of the drying algorithm.

In addition, the microcomputer 90*a* can display the decided state of the air passage to the user. However, such display is carried out after the user finishes the drying operation by the dryer 1, for preventing the user from stopping the drying operation and cleaning the line filter 41. That is, the user can be protected from a burn.

The microcomputer 90*a* has each critical step information on the clogging degree of the exhaust duct 50 and the clogging degree of the lint filter 41. If the clogging degree of the exhaust duct 50 or the clogging degree of the lint filter 41 exceeds the critical step, the microcomputer 90*a* provides the corresponding alarm and display through the display unit 9*b*. For example, the off duty ratio of 0.5 can be set as the critical step of the lint filter 41, and the off duty ratio of 0.8 can be set as the critical step of the exhaust duct 50.

Figure 11:
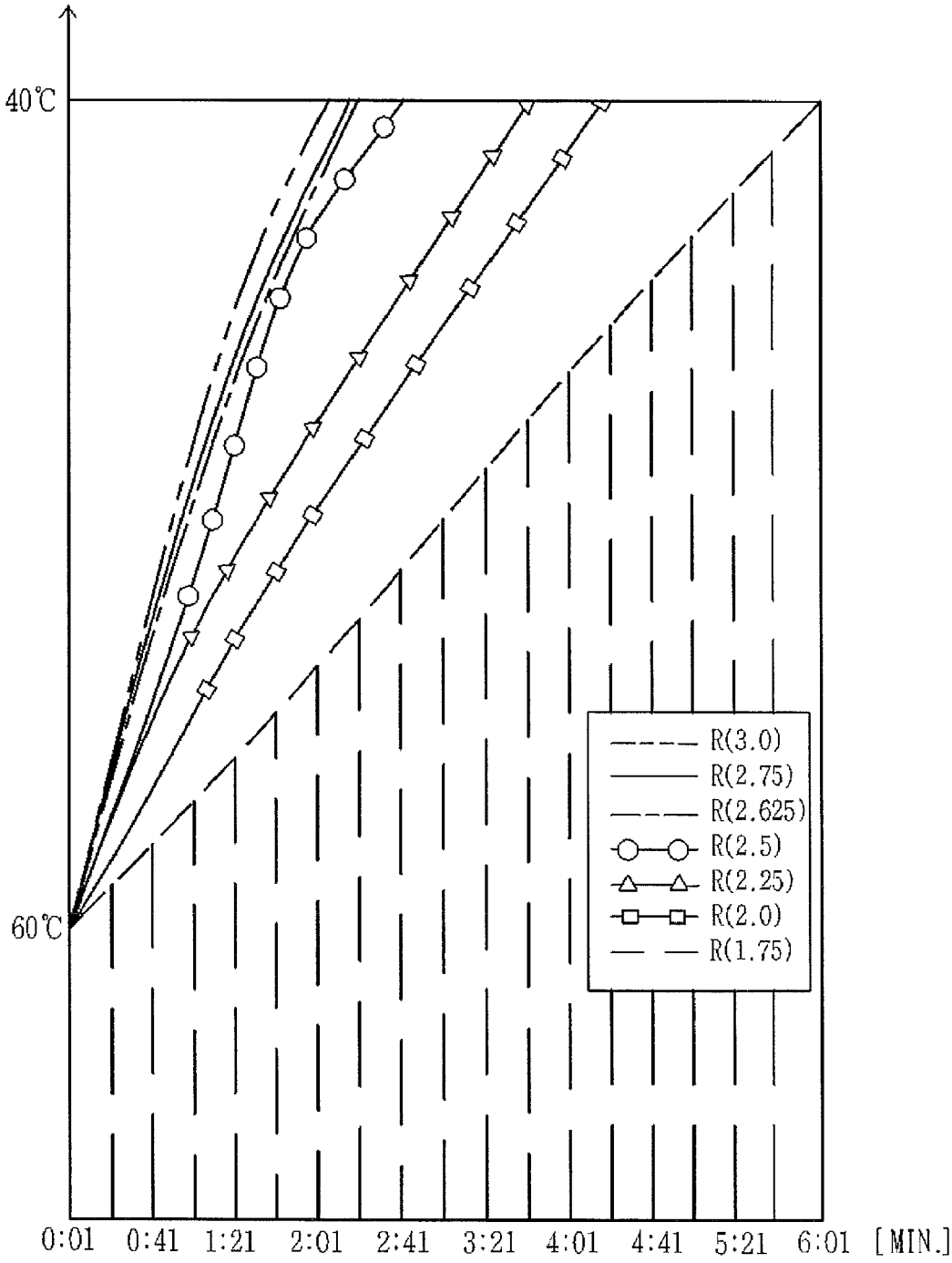
FIG. 11 is a graph showing temperature variations recognized by the microcomputer of FIG. 9.

FIG. 11 is a graph showing temperature variations recognized by the microcomputer of FIG. 9. In a non-load state where the laundry is not put into the dryer 1, after the temperature of the air heated by the heater 30 reaches 60° C., heat generation of the heater 30 is stopped. FIG. 11 shows the time taken to reach 40° C. Here, the temperature of the heated air is the temperature of the air in the suction passage 20 or the drum 10. In this embodiment, the temperature sensor 82*b* installed in the drum 10 is used.

As depicted in FIG. 11, the smaller the diameter of the exhaust duct 50 is, the more slowly the temperature of the air is lowered. The temperature of the air is influenced by the air flow passing through the exhaust duct 50. The lowering degree (for example, speed) of the temperature represents the degree of the diameter of the exhaust duct 50. As mentioned above, the diameter of the exhaust duct 50 corresponds to the state (clogging) of the air passage. The microcomputer 90*a* can check the state of the air passage according to the lowering degree of the temperature.

As described above, the microcomputer 90*a* can store the initial state of the air passage and use it as the reference state or the offset value.

Figure 12:
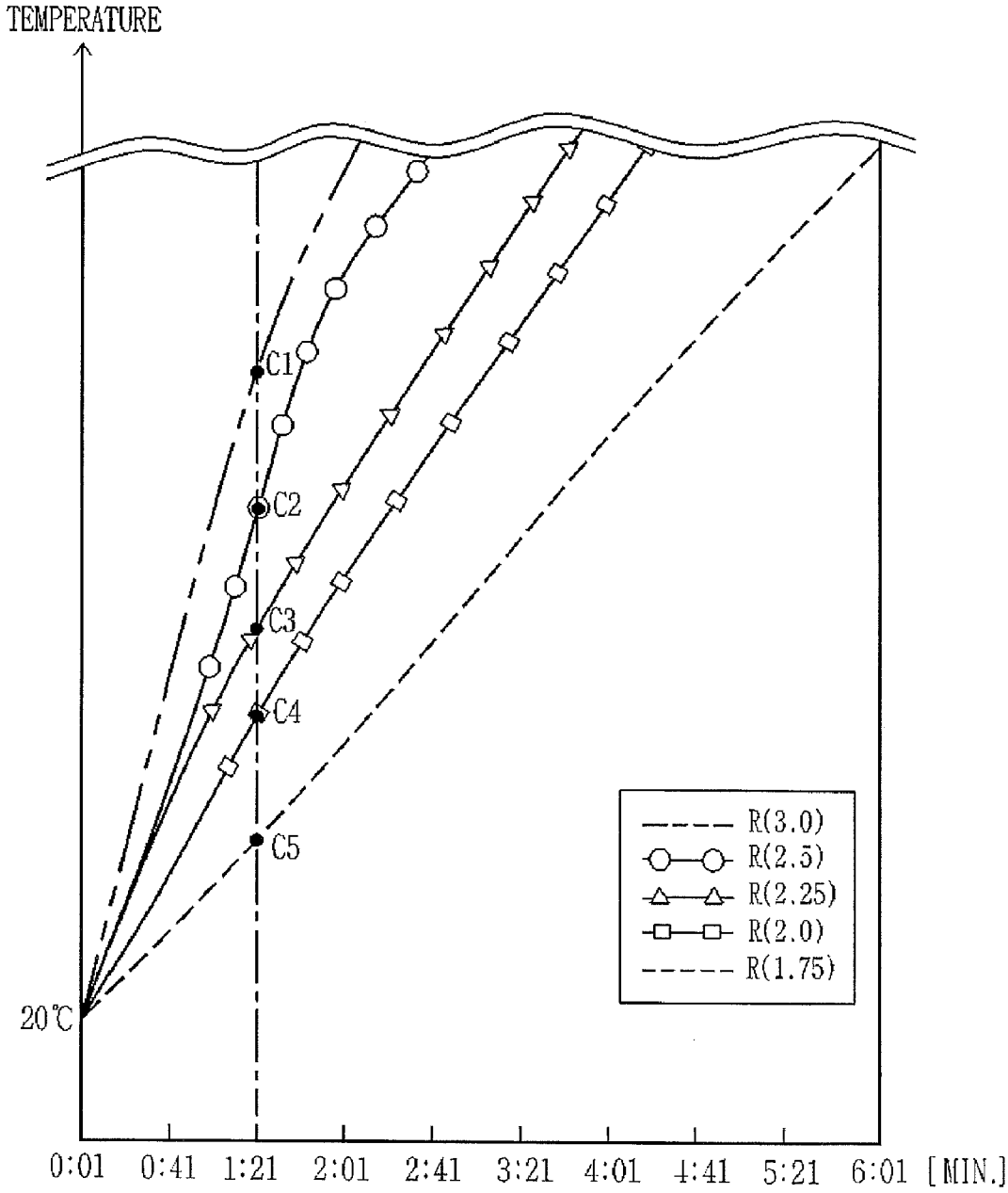
FIG. 12 is a graph showing temperature waveforms sensed by a temperature sensor.

FIG. 12 is a graph showing temperature waveforms sensed by the temperature sensor. In a non-load state where the laundry is not put into the dryer 1, the heater 30 and the motor 72 are driven. FIG. 12 shows temperature variations of the air sensed by the temperature sensor 82*a*.

As illustrated in FIG. 12, the smaller the diameter of the exhaust duct 50 is, the less the temperature of the air is varied in a predetermined time. The temperature of the air is influenced by the air flow passing through the exhaust duct 50. The variation degree (for example, speed) of the temperature relates to the degree of the diameter of the exhaust duct 50. As mentioned above, the diameter of the exhaust duct 50 corresponds to the state (clogging) of the air passage. The microcomputer 90*a* can check the state of the air passage according to the variation degree of the temperature.

For example, when the microcomputer 90*a* performs the drying operation for one minute and 21 seconds, the larger the diameter is, the higher the final temperature C1 to C5 is. Accordingly, the microcomputer 90*a* can check the clogging state or degree of the air passage according to the variation of the temperature sensed by the temperature sensor 82*a*.

The microcomputer 90*a* does not only store the clogging state or degree of the air passage, but also stores a temperature reference Tr for judging the clogging state or degree. When the drying operation is performed for a set time (for example, one minute and 21 seconds, etc.), the temperature reference Tr is compared with a difference between a temperature A before the drying operation and a temperature B after the drying operation. The temperature reference Tr (=B−A) corresponds to the temperature variation by the drying operation. The temperature reference Tr, which is one value, can be used to judge at least clogging of the exhaust duct 50. In addition, the temperature reference Tr can be set as a constant value in the drying operation in the non-load state, or variably set according to a laundry quantity in the load state.

The microcomputer 90*a* compares two or more clogging states or degrees of the air passage, and judges progression (increase or decrease) of the clogging degree of the air passage. As the dryer 1 performs the drying operation a few times, the clogging state of the air passage is changed. The microcomputer 90*a* judges the variation degree of the clogging state of the air passage, and provides it to the user through the display unit 9*b*. The microcomputer 90*a* compares the currently judged clogging state or degree of the air passage with the latest prestored clogging state or degree of the air passage, and judges the clogging progression degree of the air passage.

The microcomputer 90*a* displays the checked state of the air passage through the display unit 9*b*. In installation of the dryer 1, the microcomputer 90*a* can display successful installation to the user (or installer). That is, when the clogging degree of the air passage is serious, the microcomputer 90*a* displays a message of requiring re-installation of the dryer 1, or a message of requiring additional wall perforation on the outer wall to widen the exhaust duct 50.

The currently checked state of the air passage is influenced by the through hole of the outer wall. The clogging degree of the air passage checked after initial installation of the dryer 1 or cleaning of the lint filter 41 gets more serious due to use of the dryer 1. Therefore, the microcomputer 90*a* can judge the progressive degree of clogging.

As described above, the microcomputer 90*a* stores the initial state of the air passage and uses it as the reference state or the offset value.

The microcomputer 90 or 90*a* stores the clogging degree of the air passage in the storing unit in every drying operation according to the aforementioned methods. Meanwhile, the microcomputer 90 or 90*a* can store an initial clogging state which is a reference state, and five clogging degrees checked in the latest drying operation.

Figure 13:
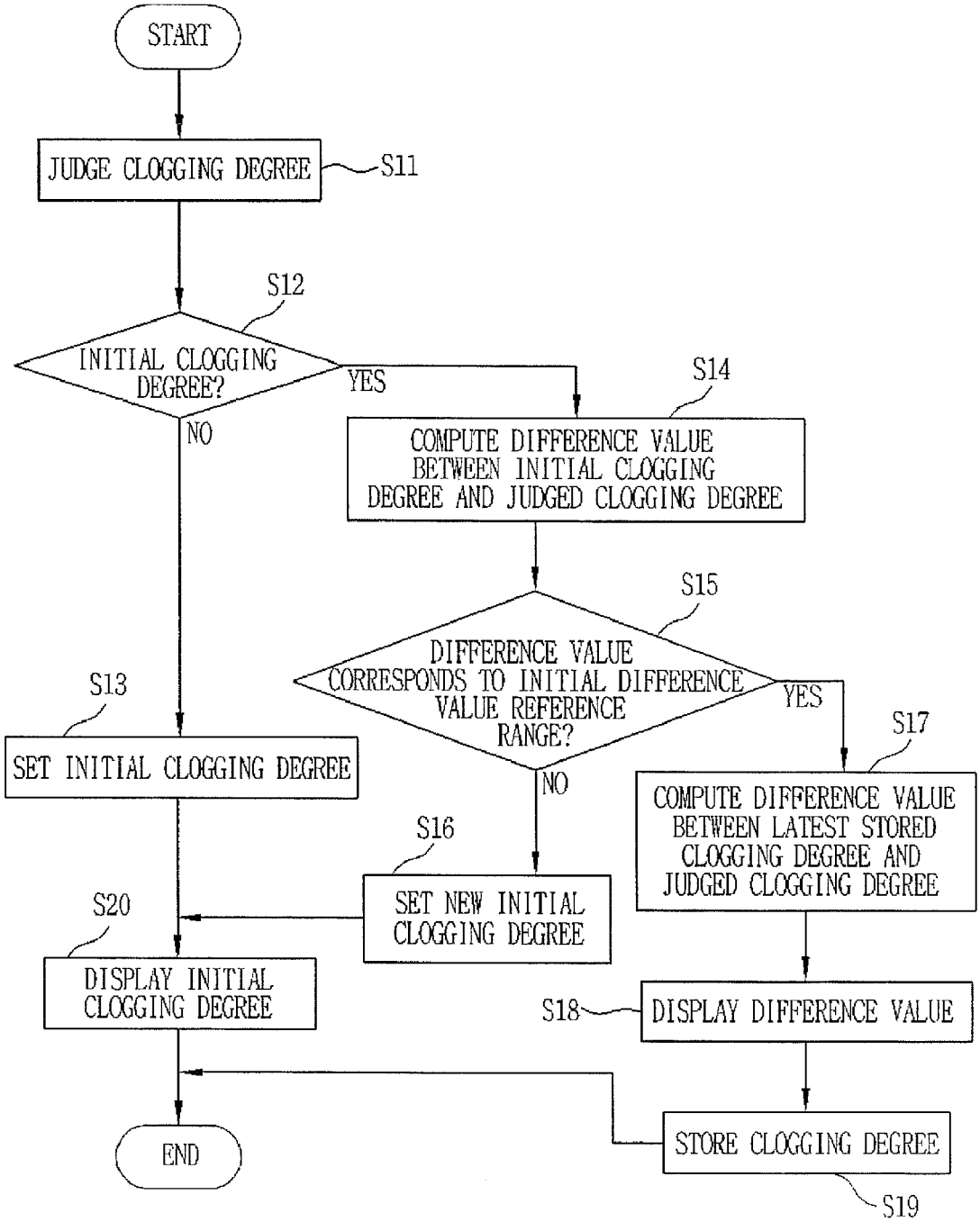
FIG. 13 is a flowchart showing sequential steps of a clogging detecting method for a dryer in accordance with a first embodiment of the present invention.
Figure 14:
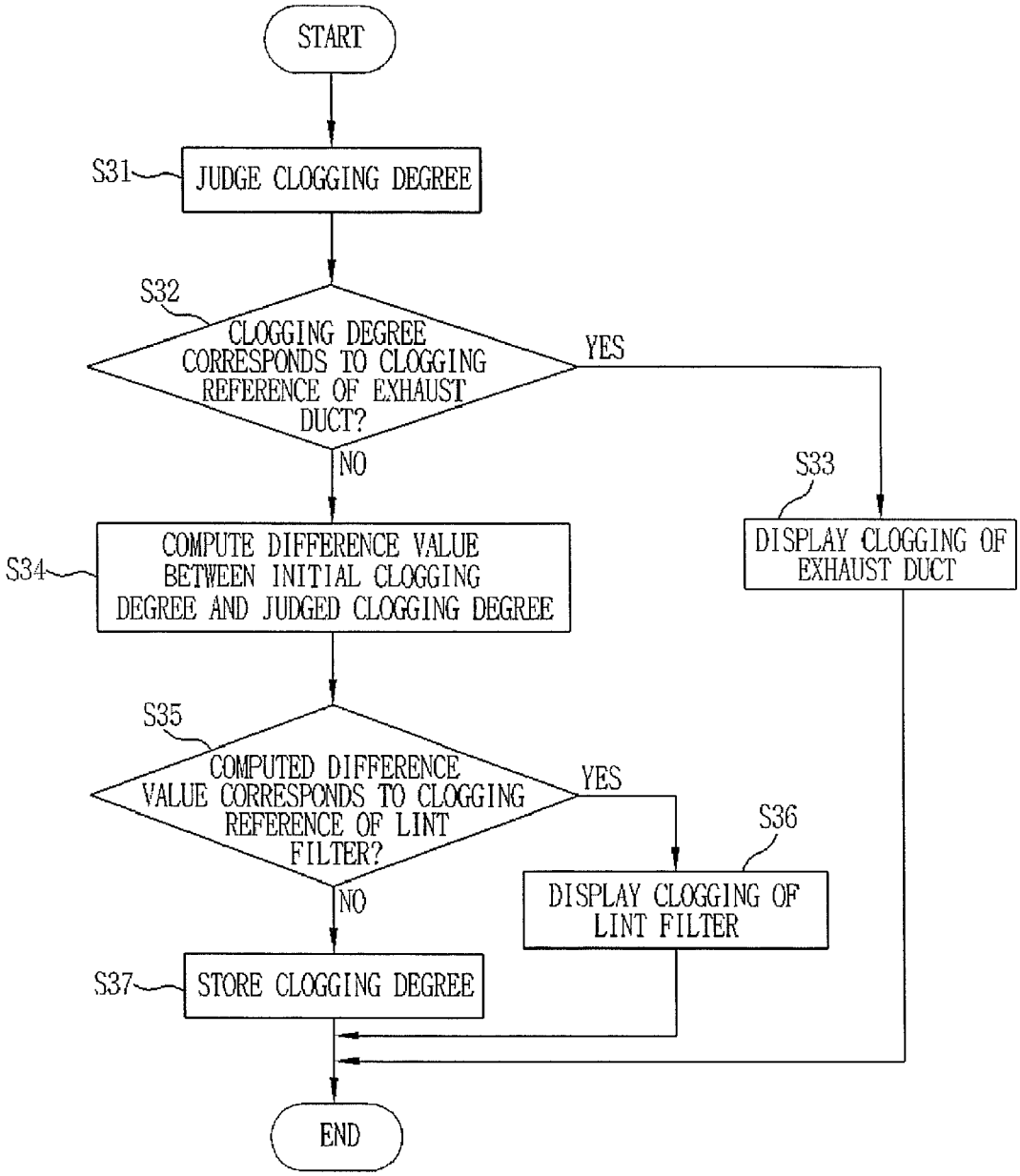
FIG. 14 is a flowchart showing sequential steps of a clogging detecting method for a dryer in accordance with a second embodiment of the present invention.

The dryer of FIGS. 4 and 9 can be applied to FIGS. 13 and 14. For convenience of explanation, the dryer of FIG. 9 and Table 1 including the on/off duty ratio of power supply are exemplified. In addition, the on duty ratio is used.

FIG. 13 is a flowchart showing sequential steps of a dryer in accordance with a first embodiment of the present invention.

In detail, in step S11, the microcomputer 90*a* judges the clogging degree of the air passage (including the suction passage 20, the exhaust passage 40 and the exhaust duct 50) of the dryer 1 according to the aforementioned method. Therefore, the microcomputer 90*a* acquires the on duty ratio (for example, 0.70). The microcomputer 90*a* can perform the above step S11 according to an individual control algorithm, or the clogging degree check command for the air passage inputted by the user through the input unit 9*a*. The input unit 9*a* can be installed at the inner portion or on the rear surface of the dryer 1, not the control panel 9, so that the installer of the dryer 1 can directly control and check the input unit 9*a*.

In step S12, the microcomputer 90*a* decides whether the prestored initial clogging degree exists. If the initial clogging degree exists, the microcomputer 90*a* goes to step S14, and if not, the microcomputer 90*a* goes to step S13.

In step S13, the microcomputer 90*a* sets the judged clogging degree as the initial clogging degree, and stores it in the storing unit. As described above, the initial clogging degree becomes the reference state. If the initial clogging degree is judged when the dryer 1 does not perform the drying operation at all or after the lint filter 41 is cleaned, the initial clogging degree means the clogging degree of the exhaust duct 50.

In step S14, the microcomputer 90*a* computes a difference value between the prestored initial clogging degree and the currently judged clogging degree. The above step S14 is provided to check progression of the clogging degree of the air passage with the initial clogging degree by the drying operation. In addition, if the dryer 1 is installed in a different space, the initial clogging degree needs to be reset.

In step S15, the microcomputer 90*a* judges whether the difference value computed in step S14 corresponds to an initial difference value reference. The initial difference value reference is provided to judge re-installation of the dryer 1, or the progression degree of the clogging state of the exhaust duct 50. As the dryer 1 performs the drying operation, the clogging degree increases. If the judged clogging degree sharply increases (if the state of the exhaust duct 50 is worsened in the current space or due to an error), or sharply decreases (if the state of the exhaust duct 50 is changed due to housing moving or repair), the above step S15 is required to update the initial clogging degree. For example, when the on duty ratio of the initial clogging degree is 0.7 and the judged clogging degree is 0.8, if the initial difference value reference is set as 4% of the initial clogging degree, the initial difference value reference becomes 0.7±0.028. Since the difference value does not correspond to the initial difference value reference, the microcomputer 90*a* goes to step S16. Conversely, when the judged clogging degree is 0.697, the difference value corresponds to the initial difference value reference, and the microcomputer 90*a* goes to step S17. The initial difference value reference is the minimum reference that can be influenced by the state of the exhaust duct 50. If the clogging degree of the lint filter 41 reaches the maximum, it influences the clogging degree judged within the initial difference value reference.

In step S16, the microcomputer 90*a* stores the judged clogging degree as a new initial clogging degree in the storing unit. In this step S16, the microcomputer 90*a* can additionally judge whether the stored initial clogging degree corresponds to the clogging degree of the exhaust duct 50 of Table 1. The difference value of step S14 represents the additional clogging degree of the exhaust duct 50. If the judged clogging degree is sharply reduced from the initial clogging degree, it means that the clogging progression degree of the exhaust duct 50 is serious. Here, the microcomputer 90*a* can delete all clogging degrees except the newly stored initial clogging degree.

In step S17, the microcomputer 90*a* computes a difference value between the latest stored clogging degree and the judged clogging degree. For example, if the latest stored clogging degree is 0.698 and the currently judged clogging degree is 0.697, the difference value becomes 0.01. The difference value represents increase of the clogging degree of the air passage, and corresponds to the clogging degree of the lint filter 41. That is, the clogging degree of the lint filter 41 slowly increases and the clogging degree of the exhaust duct 50 rapidly increases. If the clogging degree of the whole air passage slowly increases, it is caused by clogging of the lint filter 41, and if the clogging degree of the whole air passage rapidly increases, it is caused by clogging of the exhaust duct 50.

In step S18, the microcomputer 90*a* can display the difference value on the display unit 9*b*, to notify increase of the clogging degree of the lint filter 41.

In step S19, the microcomputer 90*a* stores the judged clogging degree in the storing unit. If the number of the stored clogging degrees except the initial clogging degree exceeds five, the microcomputer 90*a* can delete the oldest clogging degree. In addition, the microcomputer 90*a* stores the difference value as the clogging degree of the lint filter 41.

In step S20, the microcomputer 90*a* displays the initial clogging degree on the display unit 9*b*. If the routine comes from steps S13 and S16, the microcomputer 90*a* can display the initial clogging degree as the clogging degree or the clogged part as shown in Table 1.

The microcomputer 90*a* checks the clogging degree or clogging progression degree of the exhaust duct 50 by the steps S12 and S13 and the steps S12, S14, S15 and S16, and checks the clogging degree or clogging progression degree of the lint filter 41 by the steps S12, S14, S15 and S17. Accordingly, the microcomputer 90*a* can simultaneously or alternately display the clogging degrees of the exhaust duct 50 and the lint filter 41 on the display unit 9*b*.

In steps S17 and S18, when the microcomputer 90*a* has the initial clogging degree and the first judged clogging degree, the difference value between the initial clogging degree and the judged clogging degree represents the clogging degree of the lint filter 41. Thereafter, when the microcomputer 90*a* acquires the second judged clogging degree, the difference value between the first clogging degree and the second clogging degree corresponds to the additional clogging degree of the lint filter 41. In this manner, the microcomputer 90*a* checks the clogging increase degree of the lint filter 41 by each difference value. The sum of the difference values means the current clogging degree of the lint filter 41.

In the above flowchart, the microcomputer 90*a* can individually check the clogging degree or clogging progression degree of the exhaust duct 50 and the clogging degree or clogging progression degree of the lint filter 41.

FIG. 14 is a flowchart showing sequential steps of a clogging detecting method for the dryer in accordance with a second embodiment of the present invention.

Step S31 is identical to step S11 of FIG. 13.

In step S32, the microcomputer 90*a* decides whether the judged clogging degree corresponds to a clogging reference of the exhaust duct 50. According to the clogging degree reference of the exhaust duct 50 in Table 1, when the on duty ratio is below 0.4, the exhaust duct 50 is deemed to be clogged up. Therefore, if the judged clogging degree corresponds to the clogging degree reference, the microcomputer 90*a* goes to step S33, and if not, the microcomputer 90*a* goes to step S34.

In step S33, the microcomputer 90*a* decides that the exhaust duct 50 has been clogged up, and displays clogging of the exhaust duct 50 on the display unit 9*b*.

In step S34, the microcomputer 90*a* computes a difference value between the initial clogging degree and the judged clogging degree. For example, if the on duty ratio of the initial clogging degree is 0.7 and the judged clogging degree is 0.67, the difference value becomes 0.03. If the judged clogging degree is 0.61, the difference value becomes 0.09.

In step S35, the microcomputer 90*a* judges whether the computed difference value corresponds to a clogging reference of the lint filter 41. For example, if the clogging reference of the lint filter 41 is a difference value over 0.07, the difference value 0.03 computed in step S34 does not correspond to the clogging reference, and thus the microcomputer 90*a* goes to step S37. Meanwhile, the difference value 0.09 computed in step S34 corresponds to the clogging reference, and thus the microcomputer 90*a* goes to step S36.

In step S36, the microcomputer 90*a* decides that the lint filter 41 has been clogged up, and displays clogging of the lint filter 41 on the display unit 9*b*.

In step S37, the microcomputer 90*a* stores the judged clogging degree in the storing unit. Here, the microcomputer 90*a* can display the normal state of the air passage on the display unit 9*b*.

In FIG. 14, the microcomputer 90*a* can notify clogging of the exhaust duct 50, clogging of the lint filter 41, or the normal state of the air passage to the user according to the judged clogging degree.

Figure 15:
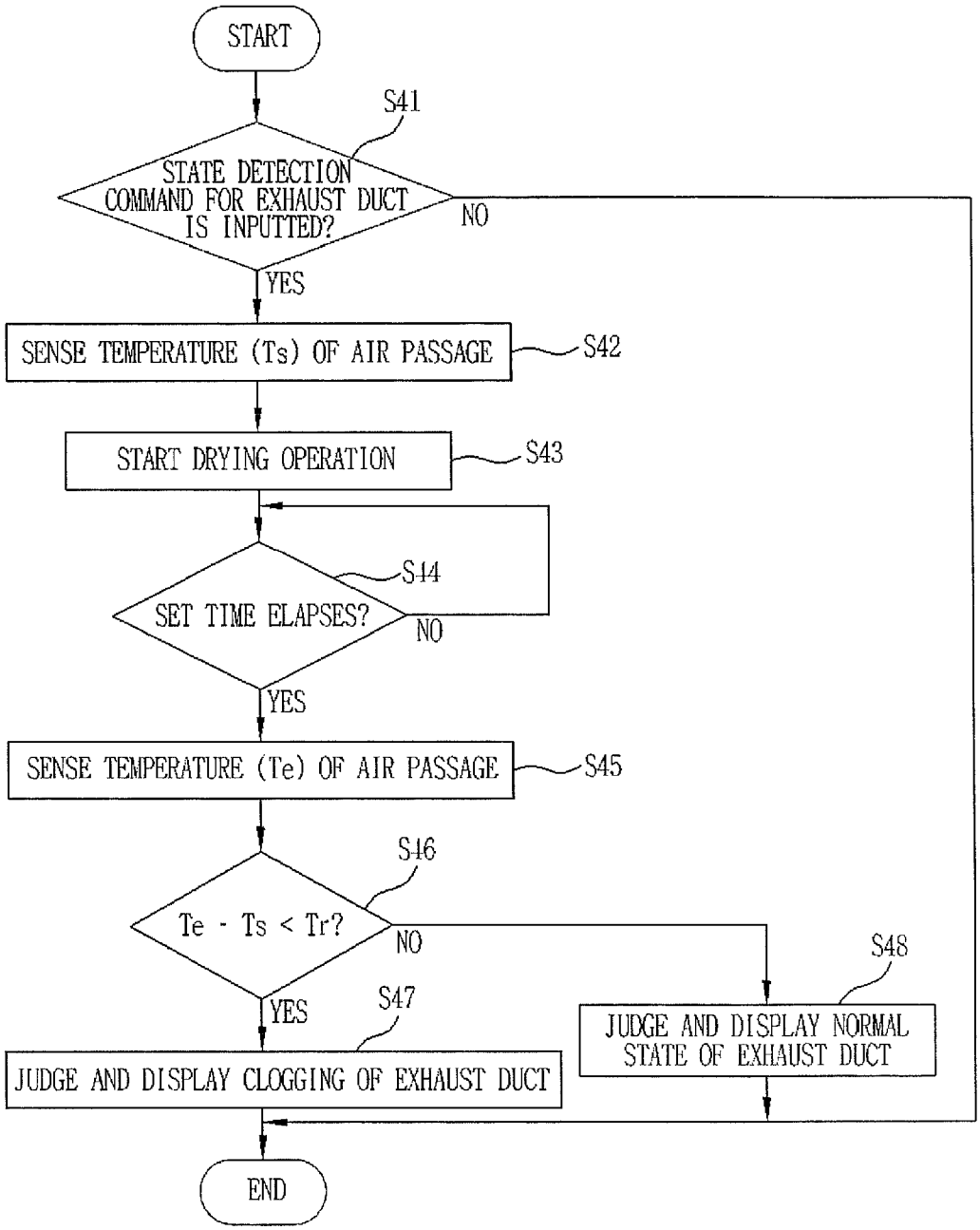
FIG. 15 is a flowchart showing sequential steps of a clogging detecting method for a dryer in accordance with a third embodiment of the present invention.

FIG. 15 is a flowchart showing sequential steps of a clogging detecting method for the dryer in accordance with a third embodiment of the present invention.

In detail, in step S41, the microcomputer 90*a* checks whether a state detection command for the exhaust duct 50 has been inputted through the input unit 9*a*. If the state detection command has been inputted, the microcomputer 90*a* goes to step S42, and if not, the microcomputer 90*a* ends the procedure. In this step S41, if the stored state detection command exists, the microcomputer 90*a* goes to step S42.

In step S42, the microcomputer 90*a* stores a temperature Ts of the air passage sensed by the temperature sensor 82*a*.

In step S43, the microcomputer 90*a* starts the drying operation of the dryer 1 by driving the heater 30 and the motor 72.

In step S44, the microcomputer 90*a* checks whether a set time for state detection (for example, one minute and 30 seconds) has elapsed. That is, the microcomputer 90*a* performs the drying operation for at least the set time by this step S44.

In step S45, the microcomputer 90*a* acquires a temperature Te of the air passage sensed by the temperature sensor 82*a*.

In step S46, the microcomputer 90*a* compares a difference value between the temperatures Te and Ts with a temperature reference Tr. The temperature reference Tr is a unique value for judging clogging of the exhaust duct 50. If the difference value is smaller than the temperature reference Tr, the microcomputer 90*a* goes to step S47, and if not, the microcomputer 90*a* goes to step S48.

In step S47, since the temperature Te has been raised from the temperature Ts below the temperature reference Tr due to clogging of the exhaust duct 50, the microcomputer 90*a* decides that the exhaust duct 50 has been clogged up, and displays clogging of the exhaust duct 50 on the display unit 9*b*. For example, if the temperature Ts is 20° C. and the temperature reference Tr is 12° C., the temperature Te does not reach 32° C.

In step S48, since the temperature Te has been raised from the temperature Ts by at least the temperature reference Tr due to clogging of the exhaust duct 50, the microcomputer 90*a* decides that the exhaust duct 50 is normal, and displays the normal state of the exhaust duct 50 on the display unit 9*b*. For example, if the temperature Ts is 20° C. and the temperature reference Tr is 12° C., the temperature Te is over 32° C.

In the temperature sensing of the above steps S42 and S45, the real temperature can be applied from the temperature sensor 82*a* to the microcomputer 90*a*. In another case, when the microcomputer 90*a* and the temperature sensor 82*a* are electrically connected and the temperature sensor 82*a* has different resistance values by temperature, if a predetermined condition (same voltage, same current, etc.) is applied to the temperature sensor unit 82, the microcomputer 90*a* can compute the resistance value of the temperature sensor 82*a*, and identify a temperature corresponding to the resistance value.

In the above-described flowchart, when the dryer 1 is firstly installed or re-installed due to house moving, in order to check only the clogging state and degree of the exhaust duct 50, a step for stopping the drying operation by the microcomputer 90*a* can be added between the steps S44 and S45.

Figure 16:
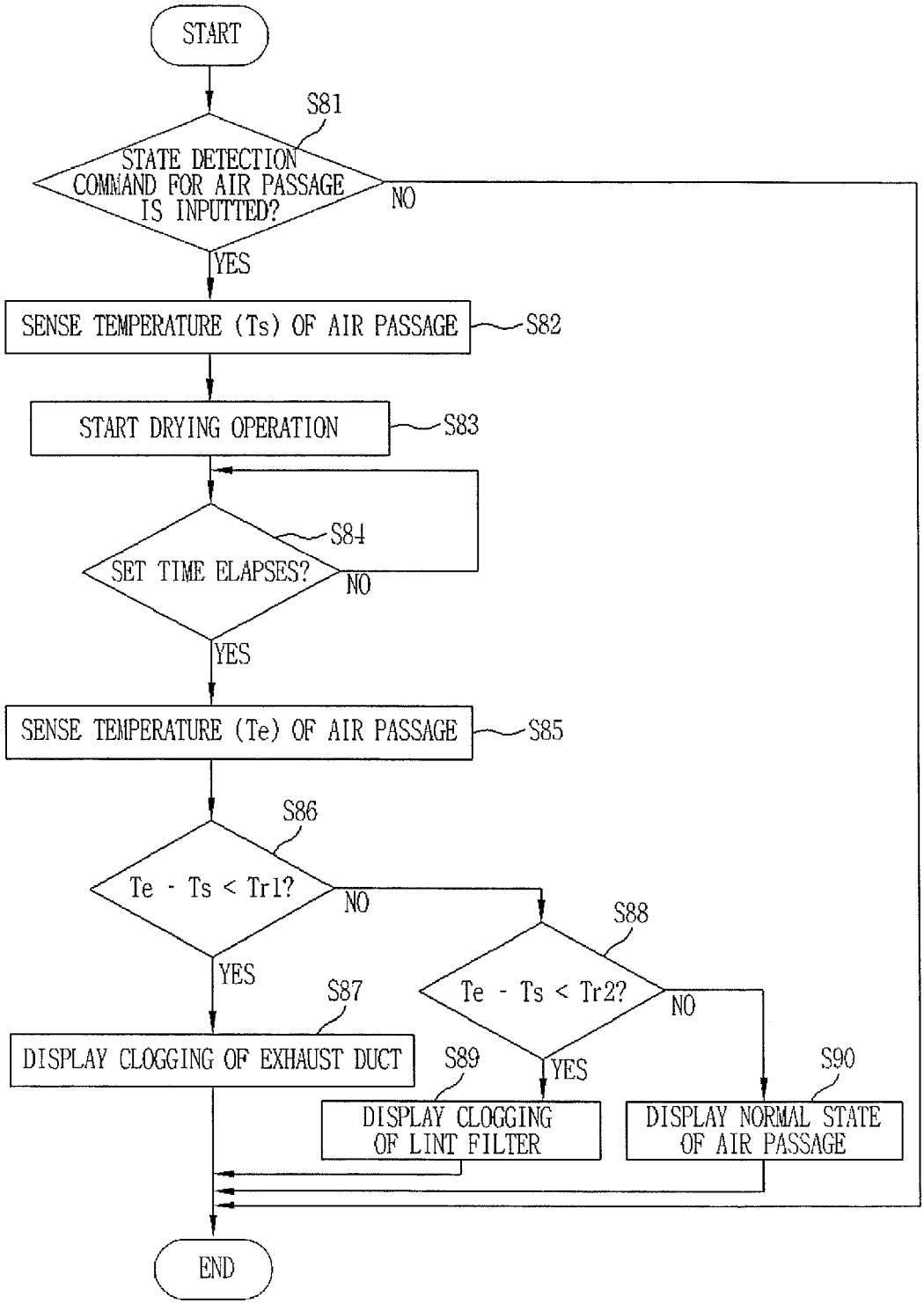
FIG. 16 is a flowchart showing sequential steps of a clogging detecting method for a dryer in accordance with a fourth embodiment of the present invention.

FIG. 16 is a flowchart showing sequential steps of a clogging detecting method for the dryer in accordance with a fourth embodiment of the present invention.

Clogging of the lint filter 41 much less affects the temperature after the drying operation than clogging of the exhaust duct 50. That is, a temperature reference Tr2 for judging clogging of the exhaust duct 50 is larger than a temperature reference Tr1 for judging clogging of the lint filter 41. Accordingly, the temperature reference Tr can be stored as a plurality of values, for identifying clogging of the lint filter 41 and clogging of the exhaust duct 50. The flowchart of FIG. 16 reflects this characteristic.

In detail, in step S81, the microcomputer 90*a* checks whether a state detection command for the air passage has been inputted through the input unit 9*a*. If the state detection command has been inputted, the microcomputer 90*a* goes to step S82, and if not, the microcomputer 90*a* ends the procedure. In this step S81, if the stored state detection command exists, the microcomputer 90*a* goes to step S82.

Steps S82 to S85 are identical to steps S42 to S45 of FIG. 15.

In step S86, the microcomputer 90*a* compares a difference value between the temperatures Te and Ts with the temperature reference Tr1. The temperature reference Tr1 is a value for judging clogging of the exhaust duct 50. If the difference value is smaller than the temperature reference Tr1, the microcomputer 90*a* goes to step S87, and if not, the microcomputer 90*a* goes to step S88.

Step S87 is identical to step S47 of FIG. 15.

In step S88, the microcomputer 90*a* compares the difference value between the temperatures Te and Ts with the temperature reference Tr2. The temperature reference Tr2 is a value for judging clogging of the lint filter 41. If the difference value is smaller than the temperature reference Tr2, the microcomputer 90*a* goes to step S89, and if not, the microcomputer 90*a* goes to step S90.

In step S89, the microcomputer 90*a* decides that the clogged part of the air passage is the lint filter 41, and displays clogging of the lint filter 41.

In step S90, the microcomputer 90*a* judges that there is no clogged part on the air passage, and displays the normal state of the air passage.

For example, when the temperature reference Tr1 is 12° C. and the temperature reference Tr2 is 20° C., if the computed difference value is smaller than the temperature reference Tr1 in step S86, the microcomputer 90*a* decides clogging of the exhaust duct 50, if the difference value is larger than the temperature reference Tr1 and smaller than the temperature reference Tr2, the microcomputer 90*a* decides clogging of the lint filter 41, and if the difference value is larger than the temperature reference Tr2, the microcomputer 90*a* decides the normal state of the air passage.

In the above steps, the microcomputer 90*a* stores the difference values between the temperatures Te and Ts. The microcomputer 90*a* judges the clogging progression degree of the air passage by comparing the difference values. In general, the difference values are reduced by repeated drying operations of the dryer 1. For example, if the latest stored difference value is 24° C. and the currently sensed difference value is 22° C., the reduction of the difference value results from the clogging progression of the lint filter 41.

Figure 17:
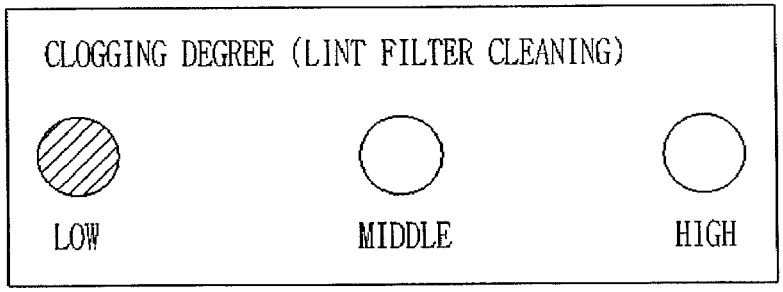
FIGS. 17 to 19 are exemplary views illustrating display examples in the clogging detecting method in accordance with the present invention.
Figure 18:
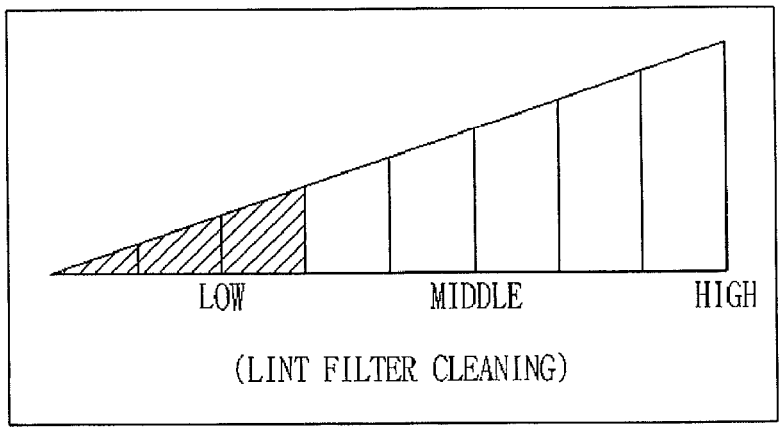
Figure 19:
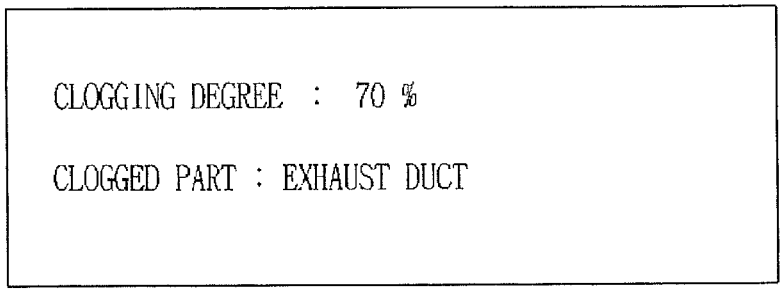

FIGS. 17 to 19 are exemplary views illustrating display examples in the clogging detecting method in accordance with the present invention.

As shown in FIG. 17, the microcomputer 90*a* compares the judged clogging degree with Table 1, and displays the clogging degree (the clogging state of the lint filter 41) and the clogged part on the display unit 9*b* by figures and characters.

As depicted in FIG. 18, the display unit 9*b* displays the clogging degree by a bar chart and characters, and also displays the clogged part by characters.

As illustrated in FIG. 19, the display unit 9*b* displays the clogging degree (the off duty ratio) by a percentage (%) and the clogged part by characters. Here, the clogging degree can be represented as the percentage by multiplying the off duty ratio by '100'. If the off duty ratio of the air passage is 0.7, it is represented as 70% clogging, which corresponds to clogging of the exhaust duct 50.

In addition, the display unit 9*b* can inform the user of the clogging degree and the clogged part through sound or alarm.

FIGS. 20 to 23 are exemplary views illustrating another display examples in the clogging detecting method in accordance with the present invention.

Figure 20:
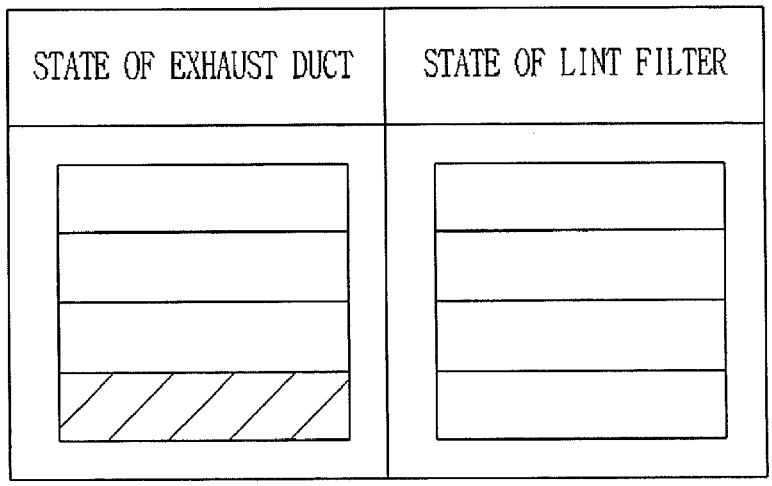
FIGS. 20 to 23 are exemplary views illustrating another display examples in the clogging detecting method in accordance with the present invention.

Referring to FIG. 20, the microcomputer 90*a* displays the clogging degree of the exhaust duct 50 which is the initial clogging degree set in steps S13 and S47, and simultaneously or alternately displays the clogging state or degree of the lint filter 41. FIG. 20 shows a state where the dryer 1 is firstly connected to the exhaust duct 50 and processed by the clogging detecting method. The lint filter 41 is not at all clogged.

Figure 21:
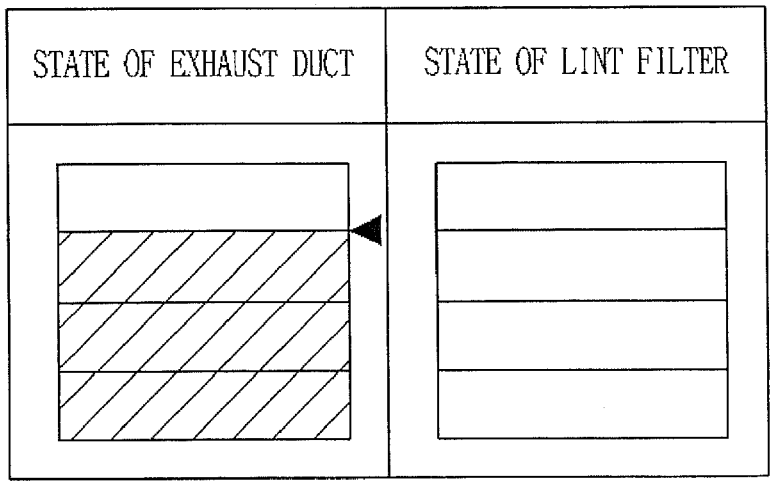

FIG. 21 shows a state where the clogging degree of the exhaust duct 50 rapidly increases from the clogging degree of FIG. 20 due to the drying operation, house moving or clogging of the exhaust duct 50 in step S16, S32 or S87. In FIG. 21, if the state of the exhaust duct 50 reaches '◀', the microcomputer 90*a* decides that the current clogging degree of the exhaust duct 50 reaches the critical step, and visibly or audibly displays a warning message (or cleaning message) for clogging of the exhaust duct 50 through the display unit 9*b*. For example, the displayed state of the exhaust duct 50 is flickered to attract the user's attention.

Figure 22:
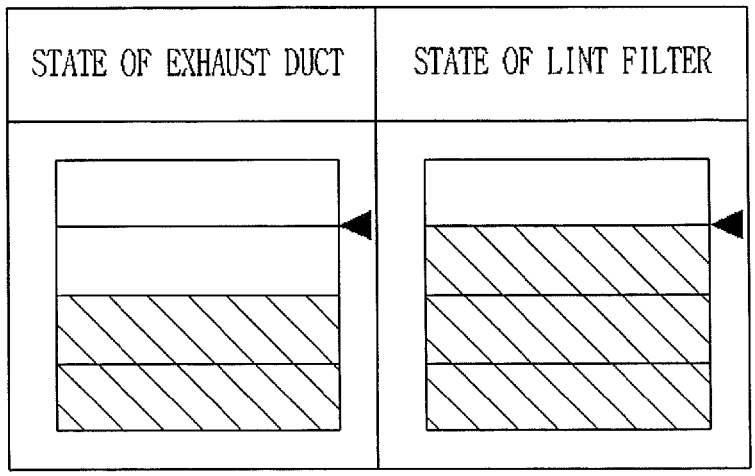

FIG. 22 shows a state where the clogging degree of the lint filter 41 slowly increases from the clogging degree of FIG. 20 due to the drying operation. If the state of the lint filter 41 reaches '◀', the microcomputer 90*a* decides that the current clogging degree of the lint filter 41 reaches the critical step, and visibly or audibly displays a warning message (or cleaning message) for clogging of the lint filter 41 through the display unit 9*b*. For example, the displayed state of the lint filter 41 is flickered to attract the user's attention.

Figure 23:
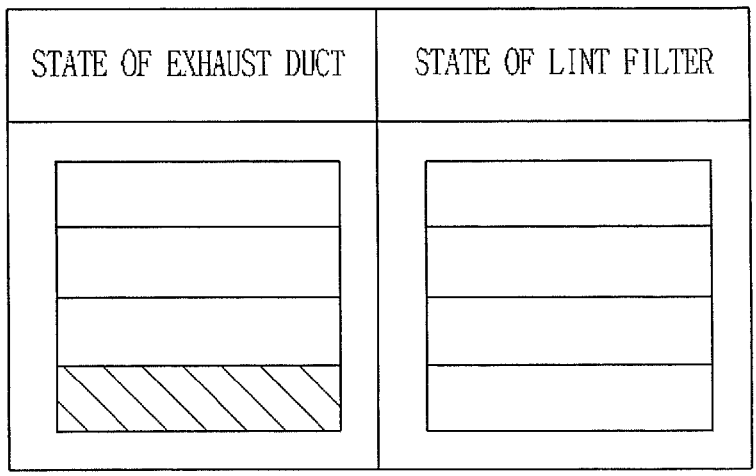

FIG. 23 shows a state change of the exhaust duct 50 by cleaning or house moving, and a state change of the lint filter 41 by cleaning in FIG. 22.

As discussed earlier, in accordance with the present invention, the dry with clogging detecting and the clogging detecting method for the dryer can precisely judge the clogging degree of the air passage, so that the user and the installer can easily cope with clogging of the air passage.

In addition, the dry with clogging detecting and the clogging detecting method for the dryer can display the current state of the air passage to the user, by checking the clogging degree and the clogged part information of the air passage.

The dry with clogging detecting and the clogging detecting method for the dryer can provide the clogging information of the air passage according to execution of the drying operation or the environmental change such as house moving and cleaning. Accordingly, the user is always informed of the current state of the air passage.

Moreover, the control panel for the dryer enables check and display of the clogging information of the air passage by the command of the user. As a result, the user can conveniently use the service of checking the clogging degree of the air passage.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A dryer with a clogging detection function, the dryer comprising:

a judgment device that judges a clogging degree of an air passage;

a storing device that stores the judged clogging degree of the air passage;

an indicator that generates an external indication of the judged clogging degree;

an operation device that performs a drying operation on the air passage; and a stopping device that intercepts a supply of power to the operation device so as to stop the drying operation of the operation device, wherein the judgment device comprises:

a detection device that detects an on/off state of the drying operation based on operation of the stopping device; and a control device that determines the clogging degree of the air passage based on the on/off state of the drying operation detected by the detection device.

2. The dryer of claim 1, wherein the indicator comprises a display that displays the clogging degree in at least two increments of the air passage.

3. The dryer of claim 2, wherein, when the clogging degree exceeds a predetermined threshold, the display displays a warning message.

4. The dryer of claim 1, wherein the indicator generates at least one of a visible indication or an audible indication of the clogging degree.

5. The dryer of claim 1, wherein the indicator comprises a display that displays a clogging degree of a lint filter and a clogging degree of an exhaust duct.

6. The dryer of claim 1, further comprising an input device that initiates a judging operation of the judgment device in response to an externally input judgment command.

7. The dryer of claim 1, further comprising a connection line that connects the detection device to the operation device or the stopping.

8. The dryer of claim 1, wherein the judgment device checks the clogging degree of the air passage by computing an on/off duty ratio of the drying operation.

9. A dryer having a clogging detection function, the dryer comprising:

a judgment device that judges a clogging degree of an air passage;

a storing device that stores the clogging degree of the air passage;

a display that displays the clogging degree;

an operation device that performs a drying operation on the air passage; and a stopping device that stops the drying operation of the operation device, wherein the stopping device transmits an off control command to the operation device according to a temperature of the air passage, and wherein the judgment device judges the clogging degree of the air passage according to an on/off state of the drying operation device.

10. The dryer of claim 9, wherein the judgment device checks the clogging degree of the air passage by computing an on/off duty ratio of the drying operation.

11. A dryer having a clogging detection function, the dryer comprising:

a judgment device that judges a clogging degree of an air passage;

a storing device that stores the clogging degree of the air passage;

a display device that displays the clogging degree to a user;

an operation device that performs a drying operation on the air passage; and a stopping device that selectively intercepts a supply of power to the operation device so as to selectively stop the drying operation of the operation device, wherein the judgment device comprises:

a detection device that detects an on/off state of the drying operation; and a control device that determines the clogging degree of the air passage according to a first off time point of the drying operation imposed by the stopping device.

12. A dryer having a clogging detection function, the dryer comprising:

a judgment device that judges a clogging degree of an air passage;

a storing device that stores the clogging degree of the air passage;

a display that displays the clogging degree; and an operation device that performs a drying operation on the air passage, wherein the judgment device comprises:

a temperature sensor that senses a temperature of the air passage; and a controller that determines the clogging degree of the air passage according to a temperature variation sensed by the temperature sensor.

13. The dryer of claim 1, further comprising a comparison device that compares the judged clogging degree with at least one prestored clogging degree of the air passage, wherein the indicator comprises a display that displays the comparison result.

14. The dryer of claim 13, further comprising an initial state setting device that sets the judged clogging degree as an initial clogging degree when a difference value between the judged clogging degree and a prestored clogging degree does not fall within an initial difference value reference range.

15. A dryer having a clogging detection function, comprising:

a judgment device that judges a clogging degree of an air passage;

a storing device that stores the judged clogging degree of the air passage;

a display that displays the judged clogging degree; and an initial state setting device that sets the judged clogging degree as an initial clogging degree when a reference clogging degree is not previously stored.

16. The dryer of claim 15, wherein the initial clogging degree corresponds to a clogging degree of an exhaust duct.

17. The dryer of claim 13, further comprising a setting device that sets a comparison result of the comparison device between the judged clogging degree and a latest stored clogging degree as the clogging degree or a progressive clogging degree of the lint filter.

18. The dryer of claim 1, further comprising:

a first comparison device that compares the judged clogging degree with a clogging reference value of an exhaust duct; and a second comparison device that compares a difference value between a prestored clogging degree and the judged clogging degree with a clogging reference value of a lint filter.

19. The dryer of claim 18, wherein the indicator comprises a display that displays clogging of the exhaust duct or clogging of the lint filter according to the comparison result of the first comparison device or the second comparison device.

* * * * *